US009233449B2

(12) United States Patent
Sano et al.

(10) Patent No.: US 9,233,449 B2
(45) Date of Patent: Jan. 12, 2016

(54) POLISHING METHOD, POLISHING APPARATUS AND GAN WAFER

(75) Inventors: Yasuhisa Sano, Osaka (JP); Kazuto Yamauchi, Osaka (JP); Junji Murata, Osaka (JP); Shun Sadakuni, Osaka (JP); Keita Yagi, Tokyo (JP)

(73) Assignees: OSAKA UNIVERSITY, Osaka (JP); EBARA CORPORATION, Tokyo (JP)

( * ) Notice: Subject to any disclaimer, the term of this patent is extended or adjusted under 35 U.S.C. 154(b) by 25 days.

(21) Appl. No.: 13/138,635

(22) PCT Filed: Mar. 19, 2010

(86) PCT No.: PCT/JP2010/055484

§ 371 (c)(1), (2), (4) Date: Sep. 13, 2011

(87) PCT Pub. No.: WO2010/110463

PCT Pub. Date: Sep. 30, 2010

(65) Prior Publication Data

US 2012/0001193 A1 Jan. 5, 2012

(30) Foreign Application Priority Data

Mar. 27, 2009 (JP) ..... 2009-078234
Dec. 15, 2009 (JP) ..... 2009-284492

(51) Int. Cl.
*H01L 21/461* (2006.01)
*B24B 37/005* (2012.01)

(52) U.S. Cl.
CPC ..... *B24B 37/0056* (2013.01)

(58) Field of Classification Search
CPC ..... B24B 1/00; B24B 37/0056; H01L 21/02008; H01L 21/0201; H01L 21/02013; H01L 21/302; H01L 21/304; H01L 21/461
USPC ..... 438/690, 691, 692, 693
See application file for complete search history.

(56) References Cited

U.S. PATENT DOCUMENTS 7,501,346 B2 * 3/2009 Grumbine ..... C09G 1/02 252/79
7,651,625 B2 1/2010 Yamauchi et al.

(Continued)

FOREIGN PATENT DOCUMENTS

EP 1 894 900 3/2008
JP 2001-205555 7/2001

(Continued)

OTHER PUBLICATIONS

Hideyuki Hara, Yasuhisa Sano, Hidekazu Mimura, Kenta Arima, Akihisa Kubota, Keita Yagi, Junji Murata and Kazuto Yamauchi, "Novel Abrasive-Free Planarization of Si and SiC Using Catalyst", The 11th International Conference on Precision Engineering (ICPE), pp. 267-270 (Aug. 16-18, 2006, Tokyo, Japan).

(Continued)

*Primary Examiner* — Jay C Kim
(74) *Attorney, Agent, or Firm* — Wenderoth, Lind & Ponack, L.L.P.

(57) ABSTRACT

A polishing method can process and flatten, in a practical processing time and with high surface accuracy, a surface of a substrate of a Ga element-containing compound semiconductor. The polishing method includes: bringing a Ga element-containing compound semiconductor substrate (16) into contact with a polishing tool (10) in the presence of a processing solution (14) comprising a neutral pH buffer solution containing Ga ions; irradiating a surface of the substrate with light or applying a bias potential to the substrate, or applying a bias potential to the substrate while irradiating the surface of the substrate with light, thereby forming Ga oxide (16*a*) on the surface of the substrate; and simultaneously moving the substrate and the polishing tool relative to each other to polish and remove the Ga oxide formed on the surface of the substrate.

6 Claims, 18 Drawing Sheets

(56) References Cited

U.S. PATENT DOCUMENTS

| | | | | |
|---|---|---|---|---|
| 7,776,228 | B2 | 8/2010 | Yamauchi et al. | |
| 2005/0269577 | A1* | 12/2005 | Ueda | C25F 3/02 257/80 |
| 2008/0073222 | A1 | 3/2008 | Yamauchi et al. | |
| 2009/0095712 | A1 | 4/2009 | Yamauchi et al. | |

FOREIGN PATENT DOCUMENTS

| | | | | |
|---|---|---|---|---|
| JP | 2007-283410 | | 11/2007 | |
| JP | 2008-81389 | | 4/2008 | |
| JP | 2008-121099 | * | 5/2008 | C23F 1/00 |
| JP | 2008-166709 | | 7/2008 | |
| JP | 2009-067620 | | 4/2009 | |

OTHER PUBLICATIONS

Hideyuki Hara, Yasuhisa Sano, Hidekazu Mimura, Kenta Arima, Akihisa Kubota, Keita Yagi, Junji Murata and Kazuto Yamauchi, "Damage-Free Planarization of 4H-SiC (0001) by Catalyst-Referred Etching", Programme of the 6th European Conference on Silicon Carbide and Related Materials (ECSCRM 2006), p. 28 (Sep. 3-7, 2006, Newcastle upon Tyne, UK).

Kenta Arima and Mizuho Morita, "Atomic-Scale Characterization of Semiconductor Surfaces after Wet Cleaning", Extended Abstracts of International 21st Century COE Symposium on Atomistic Fabrication Technology, pp. 59-60 (Oct. 19-20, 2006, Osaka, Japan).

H. Hara, Y. Sano, K. Arima, K. Yagi, J. Murata, A. Kubota, H. Mimura and K. Yamauchi, "Development of CAtalyst-Referred Etching", Extended Abstracts of International 21st Century COE Symposium on Atomistic Fabrication Technology, pp. 27-28 (Oct. 19-20, 2006, Osaka, Japan).

K. Yagi, J. Murata, H. Hara, Y. Sano, K. Yamauchi and H. Goto, "Fabrication of Damascene Cu Wiring Using Solid Acid Catalyst", Extended Abstracts of International 21st Century COE Symposium on Atomistic Fabrication Technology, pp. 85-86 (Oct. 19-20, 2006, Osaka, Japan).

Ryota Okamoto, Kenta Arima, Hideyuki Hara, Yasuhisa Sano, Takeshi Ishida, Keita Yagi, Akihisa Kubota, Katsuyoshi Endo and Kazuto Yamauchi, "Scanning Tunneling Microscopy Study of 4H-SiC (0001) Surfaces After Wet-Chemical Preparations", Extended Abstracts of International 21st Century COE Symposium on Atomistic Fabrication Technology, pp. 125-126 (Oct. 19-20, 2006, Osaka, Japan).

Keita Yagi, Junji Murata, Yasuhisa Sano, Hideyuki Hara, Kenta Arima, Takeshi Okamoto, Hidekazu Mimura and Kazuto Yamauchi, "Damage-Free Planarization of 4H-SiC Using Catalyst Plate", Proceedings of 15th International Conference on Crystal Growth, Abstract#859 (Aug. 12-17, 2007, Salt Lake City, USA).

Junji Murata, Akihisa Kubota, Keita Yagi, Yasuhisa Sano, Hideyuki Hara, Kenta Arima, Takeshi Okamoto, Hidekazu Mimura and Kazuto Yamauchi, "Damage-Free Planarization of GaN Using a Catalyst Plate", Proceedings of 15th International Conference on Crystal Growth, Abstract#789 (Aug. 12-17, 2007, Salt Lake City, USA).

Hideyuki Hara, Yasuhisa Sano, Kenta Arima, Keita Yagi, Junji Murata, Takeshi Okamoto, Hidekazu Mimura and Kazuto Yamauchi, "New Crystal Planarization Technique Using a Catalyst Plate", Proceedings of 15th International Conference on Crystal Growth, Abstract#769 (Aug. 12-17, 2007, Salt Lake City, USA).

Kenta Arima and Mizuho Morita, "Development of Wet-Chemical Procedures to Control Emerging Semiconductor Surfaces on the Atomic Scale", Extended Abstracts of International 21st Century COE Symposium on Atomistic Fabrication Technology 2007, pp. 51-52 (Oct. 15-17, 2007, Osaka, Japan).

Keita Yagi, Yasuhisa Sano, Hideyuki Hara, Junji Murata, Kenta Arima, Takeshi Okamoto, Hidekazu Mimura and Kazuto Yamauchi, "Development of Planarization Equipment Using Catalyst-Referred Etching", Extended Abstracts of International 21st Century COE Symposium on Atomistic Fabrication Technology 2007, pp. 35-36 (Oct. 15-17, 2007, Osaka, Japan).

Akihisa Kubota, Keita Yagi, Junji Murata, Heiji Yasui, Shiro Miyamoto, Hideyuki Hara, Yasuhisa Sano and Kazuto Yamauchi, "Polishing Characteristics of Single Crystal SiC Surface Finished by Fe-Catalyst Rod under $H_2O_2$ Solution", Extended Abstracts of International 21st Century COE Symposium on Atomistic Fabrication Technology 2007, pp. 129-130 (Oct. 15-17, 2007, Osaka, Japan).

Junji Murata, Akihisa Kubota, Keita Yagi, Yasuhisa Sano, Hideyuki Hara, Kenta Arima, Takeshi Okamoto, Hidekazu Mimura and Kazuto Yamauchi, "Novel Abrasive-Free Planarization of GaN Using a Catalytic Reference Plate", Extended Abstracts of International 21st Century COE Symposium on Atomistic Fabrication Technology 2007, pp. 127-128 (Oct. 15-17, 2007, Osaka, Japan).

Hideyuki Hara, Yasuhisa Sano, Takeshi Okamoto, Kenta Arima, Keita Yagi, Junji Murata, Akihisa Kubota, Hidekazu Mimura, Kazuto Yamauchi, "Planarization Mechanism of Catalyst-Referred Etching", Extended Abstracts of International 21st Century COE Symposium on Atomistic Fabrication Technology 2007, pp. 37-38 (Oct. 15-17, 2007, Osaka, Japan).

Kenta Arima, Ryosuke Suga, Hideyuki Hara, Junji Murata, Keita Yagi, Hidekazu Mimura, Yasuhisa Sano and Kazuto Yamauchi, "Atomically Resolved STM Study of 4H-SiC (0001) Surfaces Flattened by Chemical Etching in HF Solutions with Pt Catalyst", International Conference on Silicon Carbide and Related Materials 2007, Technical Digest (ICSCRM 2007), pp. We-28-We-29 (Oct. 14-19, 2007, Otsu, Japan).

J. Murata, A. Kubota, K. Yagi, Y. Sano, H. Hara, K. Arima, T. Okamoto, H. Mimura and K. Yamauchi, "New Chemical Planarization of SiC and GaN Using Fe Plate in $H_2O_2$ Solution", International Conference on Silicon Carbide and Related Materials 2007, Technical Digest (ICSCRM 2007), pp. Th-13-Th-14 (Oct. 14-19, 2007, Otsu, Japan).

T. Okamoto, Y. Sano, H. Hara, K. Arima, K. Yagi, J. Murata, H. Mimura and K. Yamauchi, "Damage-Free Planarization of 2-inch 4H-SiC Wafer Using Pt Catalyst Plate and HF Solution", International Conference on Silicon Carbide and Related Materials 2007, Technical Digest (ICSCRM 2007), pp. We-94-We-95 (Oct. 14-19, 2007, Otsu, Japan).

K. Yamauchi, Y. Sano, K. Arima, H. Hara, J. Murata, K. Yagi and T. Okamoto, "Catalyst-Referred Etching—Damage-Free Planarization of 4H-SiC (0001)", 4th International Workshop on Crystal Growth Technology, p. 87 (May 18-25, 2008, Beatenberg above Interlaken, Switzerland).

Y. Sano, K. Yamamura and K. Yamauchi, "Development of Ultraprecision Machining Technologies for Semiconductor Substrates", Extended Abstracts of First International Symposium on Atomically Controlled Fabrication Technology—Surface and Thin Film Processing-, pp. 16-17 (Feb. 16-17, 2009, Osaka, Japan).

H. Hara, Y. Morikawa, Y. Sano, and K. Yamauchi, "First-Principles Calculation of Surface Energy at 4H-SiC(0001)-1×1", Extended Abstracts of First International Symposium on Atomically Controlled Fabrication Technology—Surface and Thin Film Processing-, pp. 62-63 (Feb. 16-17, 2009, Osaka, Japan).

J. Murata, S. Sadakuni, K. Yagi, H. Hara, K. Arima, T. Okamoto, H. Mimura and K. Yamauchi, "Photo-Enhanced Chemical Planarization of Gallium Nitride Using a Solid Acidic Catalyst", Extended Abstracts of First International Symposium on Atomically Controlled Fabrication Technology—Surface and Thin Film Processing-, pp. 60-61 (Feb. 16-17, 2009, Osaka, Japan).

T. Okamoto, Y. Sano, H. Hara, T. Hatayama, K. Arima, K. Yagi, J. Murata, H. Mimura, T. Fuyuki and K. Yamauchi, "Novel Abrasive-Free Chemical Planarization of 4H-SiC 8°off Wafer Using a Catalyst", Extended Abstracts of First International Symposium on Atomically Controlled Fabrication Technology—Surface and Thin Film Processing-, pp. 64-65 (Feb. 16-17, 2009, Osaka, Japan).

International Search Report issued Jun. 15, 2010 in International (PCT) Application No. PCT/JP2010/055484.

Written Opinion of the International Searching Authority issued Jun. 15, 2010 in International (PCT) Application No. PCT/JP2010/055484.

Supplementary European Search Report dated Jun. 17, 2013 in corresponding European Patent Application No. 10756259.7.

Bardwell et al., "Ultraviolet Photoenhanced Wet Etching of GaN in $K_2S_2O_8$ Solution", Journal of Applied Physics, vol. 89, No. 7, Apr. 1, 2001, pp. 4142-4149.

* cited by examiner

POLISHING METHOD, POLISHING APPARATUS AND GAN WAFER

TECHNICAL FIELD

The present invention relates to a polishing method and a polishing apparatus, and more particularly to a polishing method and a polishing apparatus for processing and flattening a surface (surface to be processed) of a substrate, such as an elemental substrate of a compound semiconductor containing Ga (gallium) element or a bonded substrate (epitaxial substrate) having a layer of Ga element-containing compound semiconductor.

The present invention also relate to a GaN wafer produced by the polishing method.

BACKGROUND ART

As a chemical processing method which takes the place of mechanical processing and is capable of processing a surface of a substrate without producing a lattice defect, a so-called photoelectrochemical etching method is known, which performs etching of a surface of a substrate in an acidic or basic processing solution by irradiating the surface of the substrate with ultraviolet rays or by applying a potential bias to the substrate. The photoelectrochemical etching method, by the assistance of a light energy and an electrical energy, enables processing of a surface of a substrate only through a chemical action with little damage to the surface of the substrate. The photoelectrochemical etching method, however, is not generally suited for processing and flattening of a surface of a substrate because this method lacks a flattening reference and, in addition, involves defect selectivity, and the like.

Chemical mechanical polishing (CMP) is also widely known which uses a polishing liquid containing an abrasive, such as $SiO_2$ or $Cr_2O_3$, and performs processing of a surface of a substrate by denaturing the surface of the substrate and mechanically removing the denatured layer. Because CMP involves a mechanical action, such a denatured layer cannot be fully removed by CMP. Further, it is generally difficult for CMP to process and flatten a surface of a Ga element-containing compound semiconductor substrate at a sufficient processing rate.

The applicant has proposed a catalyst-referred chemical processing method which comprises disposing a substrate in an oxidizing processing solution, disposing an acidic or basic solid catalyst in contact with or in close proximity to a surface (surface to be processed) of the substrate, and dissolving surface atoms of the surface to be processed, in contact with or in close proximity to the solid catalyst, in the oxidizing processing solution, thereby processing the surface to be processed (see Japanese Patent Laid-Open Publication No. 2008-121099). In this catalyst-referred chemical processing method, oxidation of the surface to be processed can be promoted and the processing rate can be increased by irradiating the surface of the substrate (object to be processed), disposed in the processing solution, with light, preferably ultraviolet light, or by applying a voltage between the substrate and the solid catalyst. This catalyst-referred chemical processing method enables processing of a surface of a substrate only through a chemical action with little damage to the surface of the substrate. It is, however, generally difficult for this method to process and flatten a surface of a Ga element-containing compound semiconductor substrate at a sufficient processing rate.

SUMMARY OF THE INVENTION

When a surface of a Ga (gallium) element-containing compound semiconductor substrate, such as a GaN substrate, is irradiated with light, preferably ultraviolet light, or a bias potential is applied to the substrate, GaN is oxidized to form Ga oxide ($Ga_2O_3$) on the surface of the GaN substrate as indicated by the following chemical equation (1):

$$4GaN+7O_2 \rightarrow 2Ga_2O_3+4NO_2\uparrow \quad (1)$$

The Ga oxide ($Ga_2O_3$), formed on the surface of the GaN substrate, reacts with an acid ($H^+$) in an acidic solution and dissolves in the solution at a high rate in accordance with the following chemical equation (2), or reacts with a base ($OH^-$) in a basic solution and dissolves in the solution at a high rate in accordance with the following chemical equation (3):

$$Ga_2O_3+6H^+ \rightarrow 2Ga^{3+}+3H_2O \quad (2)$$

$$Ga_2O_3+3H_2O+2OH^- \rightarrow 2[Ga(OH)_4]^- \quad (3)$$

Also in the case where a neutral processing solution is used, due to the presence of a slight amount of $H^+$ ions and $OH^-$ ions in the solution, Ga oxide formed on a surface of a GaN substrate dissolves in the processing solution by the reactions of the above formulae (2) and (3).

Thus, when processing and flattening a surface of a Ga element-containing compound semiconductor substrate, such as a GaN substrate, having surface irregularities by a conventional polishing method, dissolution of Ga oxide will occur in recessed portions of the surface of the substrate as well as in raised portions. This makes it difficult to selectively remove the tops of the raised portions of the substrate surface having surface irregularities while inhibiting removal in the recessed portions of the substrate surface, and necessitates a considerably long time to flatten the substrate surface.

The present invention has been made in view of the above situation. It is therefore an object of the present invention to provide a polishing method and a polishing apparatus which can process and flatten, in a practical processing time and with high surface accuracy, a surface of a substrate of a Ga (gallium) element-containing compound semiconductor, such as GaN, GaAs or GaP, whose importance as a material for a light-emitting device or an electronic device is increasing these days.

Another object of the present invention is to provide a GaN wafer produced by the polishing method.

In order to achieve the object, the present invention provides a polishing method comprising: bringing a Ga element-containing compound semiconductor substrate into contact with a polishing tool in the presence of a processing solution comprising a neutral pH buffer solution containing Ga ions; irradiating a surface of the substrate with light or applying a bias potential to the substrate, or applying a bias potential to the substrate while irradiating the surface of the substrate with light, thereby forming Ga oxide on the surface of the substrate; and simultaneously moving the substrate and the polishing tool relative to each other to polish and remove the Ga oxide formed on the surface of the substrate.

According to this method, Ga oxide ($Ga_2O_3$) formed on a surface of a Ga element-containing compound semiconductor substrate is polished and removed by moving the substrate and a polishing tool relative to each other while keeping them in contact in the presence of a processing solution comprising a neutral pH buffer solution containing Ga ions. This makes it possible to selectively remove the Ga oxide formed at the tops of raised portions of the surface of the substrate, having surface irregularities, while inhibiting dissolution of the Ga oxide, formed in recessed portions of the surface of the substrate, in the processing solution, and to shorten the time it takes to flatten the surface of the substrate. The pH of the neutral pH buffer solution is, for example, 6.0 to 8.0. The Ga ion concentration of the buffer solution is preferably not less than 10 ppm.

The present invention also provides a polishing method comprising: bringing a Ga element-containing compound semiconductor substrate into contact with a polishing tool in the presence of a processing solution comprising a neutral pH buffer solution containing Ga ions; carrying out a first polishing step comprising applying a bias voltage to the substrate while irradiating a surface of the substrate with light, thereby forming Ga oxide on the surface of the substrate, and simultaneously moving the Ga oxide and the polishing tool relative to each other while keeping them in contact to polish and remove the Ga oxide; and then carrying out a second polishing step without the application of the bias voltage while irradiating the surface of the substrate with light.

According to this method, while forming Ga oxide on a surface of a substrate both by irradiation of the surface of the substrate with light and by application of a bias voltage to the substrate, the Ga oxide is polished and removed from the surface of the substrate in the first polishing step. The first polishing step can ensure a sufficient polishing rate and, even when there is a large damaged portion in the surface of the substrate, can securely remove the damaged portion. Further, by continuing polishing of the surface of the substrate while carrying out only the light irradiation of the surface of the substrate in the second polishing step, excessive growth of the Ga oxide on the surface of the substrate can be prevented and the flatness of the surface of the substrate after polishing can be enhanced.

In a preferred aspect of the present invention, when shifting the first polishing step to the second polishing step, the bias voltage applied is gradually decreased, or a pulse voltage is used as the bias voltage and the application off time of the pulse voltage is gradually increased.

When polishing a surface of a substrate while forming Ga oxide on the surface of the substrate by at least one of irradiation of the surface of the substrate with light and application of a bias voltage to the substrate, the rate of oxidation of the surface of the substrate will be low in a damaged area of the surface. Thus, the unevenness of surface damage may cause in-plane unevenness of the polishing rate. To deal with this problem, it is conceivable to apply a sufficiently high bias voltage to a substrate so as to increase the rate of oxidation of the substrate surface. This method can uniformly oxidize the entire substrate surface without depending on surface damage. This method, however, has the drawback that Ga oxide can grow faster than it is removed, resulting in excessive growth of the Ga oxide and attendant roughening of the substrate surface. According to the present invention, after forming a thin Ga oxide film over the entire substrate surface by applying a high bias voltage to the substrate, the bias voltage applied is gradually decreased, or a pulse voltage is used as the bias voltage and the application off time of the pulse voltage is gradually increased. This makes it possible to, perform processing of the substrate surface while preventing excessive growth of the Ga oxide film.

In a preferred aspect of the present invention, in the second polishing step, the intensity of irradiating light is gradually decreased.

This can prevent the Ga oxide from remaining on the surface of the substrate after completion of the second polishing step.

In any of the above-described polishing methods according to the present invention, the polishing tool may have an acidic or basic solid catalyst at least in a surface area which comes into contact with or close to the substrate.

As indicated by the above formulae (2) and (3), Ga oxide ($Ga_2O_3$) has the property of reacting with an acid ($H^+$) or a base ($OH^-$) and dissolving in a solution at a high rate. Accordingly, by providing an acidic or basic solid catalyst at least in a surface area, which comes into contact with or close to a substrate, of a polishing tool which moves relative to Ga oxide while keeping contact with it and removes the Ga oxide, and thereby generating a large amount of hydrogen ions ($H^+$) or hydroxyl ions ($OH^-$) at the surface of the solid catalyst, it becomes possible to promote the Ga oxide removal reaction at the tops of raised portions of the surface of the substrate, thereby further shortening the time it takes to process and flatten the surface of the substrate.

In any of the above-described polishing methods according to the present invention, the processing solution may further contain metal oxide particles, diamond particles, or catalyst particles whose surfaces are modified with an acidic or basic functional group, or a mixture of these particles.

The use of such particles can more efficiently remove Ga oxide, thereby further shortening the time it takes to process and flatten the surface of the substrate.

In any of the above-described polishing methods according to the present invention, the processing solution may further contain an oxidizing agent.

The use of an oxidizing agent can promote the Ga oxide producing reaction, thereby further shortening the time it takes to process and flatten the surface of the substrate.

In any of the above-described polishing methods according to the present invention, at least a surface area of the polishing tool, which comes into contact with or close to the substrate preferably, has been conditioned so that it has desired flatness and appropriate roughness.

For example, the surface of the polishing tool has been conditioned (roughened) so that it has a PV (peak-to-valley) flatness of about 0.1 to 1 μm. This can prevent a surface of a substrate from being not polished due to the lubricating action of the processing solution present between the surface of the substrate and the surface of the polishing tool, and can also prevent the formation of streaks on the surface of the substrate.

The present invention also provides a polishing apparatus comprising: a container for holding a processing solution comprising a neutral pH buffer solution containing Ga ions; a polishing tool disposed in the container and which is to be immersed in the processing solution; a substrate holder for holding a Ga element-containing compound semiconductor substrate, immersing the substrate in the processing solution in the container and bringing the substrate into contact with the polishing tool; at least one of a light source for emitting light toward a surface of the substrate, held by the substrate holder and immersed in the processing solution in the container, and a power source for applying a bias potential to the substrate; and a movement mechanism for moving the polishing tool and the substrate held by the substrate holder relative to each other.

The present invention also provides a polishing apparatus comprising: a polishing tool; a substrate holder for holding a Ga element-containing compound semiconductor substrate and bringing the substrate into contact with the polishing tool; a processing solution supply section for supplying a processing solution, comprising a neutral pH buffer solution containing Ga ions, to an area of contact between the polishing tool and the substrate; at least one of a light source for emitting light toward a surface of the substrate, held by the substrate holder and kept in contact with the polishing tool, and a power source for applying a bias potential to the substrate; and a movement mechanism for moving the polishing tool and the substrate held by the substrate holder relative to each other.

In any of the above-described polishing apparatuses according to the present invention, the polishing tool may have an acidic or basic solid catalyst at least in a surface area which comes into contact with or close to the substrate.

In any of the above-described polishing apparatuses according to the present invention, the processing solution may further contain metal oxide particles, diamond particles, or catalyst particles whose surfaces are modified with an acidic or basic functional group, or a mixture of these particles.

In any of the above-described polishing apparatuses according to the present invention, the processing solution may further contain an oxidizing agent.

In any of the above-described polishing apparatuses according to the present invention, the polishing apparatus may further comprise a conditioning mechanism for conditioning at least a surface area of the polishing tool which comes into contact with or close to the substrate, so that it has desired flatness and appropriate roughness.

In any of the above-described polishing apparatuses according to the present invention, the substrate holder may be configured to hold the substrate while feeding electricity to a back surface of the substrate.

The present invention also provides a GaN wafer having a flattened surface, the flattened surface has been formed by a process comprising: bringing a GaN wafer into contact with a polishing tool in the presence of a processing solution comprising a neutral pH buffer solution containing Ga ions; irradiating a surface of the GaN wafer with light or applying a bias potential to the GaN wafer, or applying a bias potential to the GaN wafer while irradiating the surface of the GaN wafer with light, thereby forming Ga oxide on the surface of the GaN wafer; and simultaneously moving the GaN wafer and the polishing tool relative to each other to polish and remove the Ga oxide formed on the surface of the GaN wafer.

The present invention also provides a GaN wafer having a flattened surface, the flattened surface has been formed by a process comprising: bringing a GaN wafer into contact with a polishing tool in the presence of a processing solution comprising a neutral pH buffer solution containing Ga ions; carrying out a first polishing step comprising applying a bias voltage to the GaN wafer while irradiating a surface of the GaN wafer with light, thereby forming Ga oxide on the surface of the GaN wafer, and simultaneously moving the Ga oxide and the polishing tool relative to each other while keeping them in contact to polish and remove the Ga oxide; and then carrying out a second polishing step without the application of the bias voltage while irradiating the surface of the GaN wafer with light.

According to the present invention, a surface of a substrate of a Ga element-containing compound semiconductor, such as GaN, GaAs or GaP, can be polished and flattened in a significantly shortened processing time while ensuring sufficient surface accuracy.

DETAILED DESCRIPTION OF THE INVENTION

Preferred embodiments of the present invention will now be described with reference to the drawings.

Figure 1A:
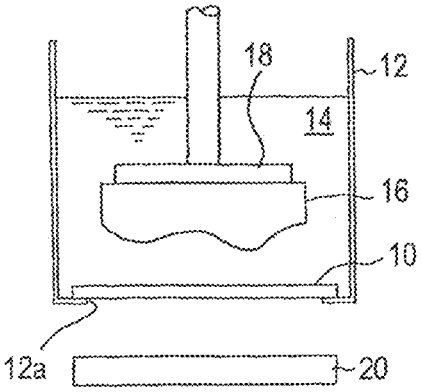
FIGS. 1A through 1D illustrate, in a sequence of process steps, a method for polishing and flattening a surface of a substrate while irradiating the surface with light according to the present invention.

FIGS. 1A through 1D illustrate, in a sequence of process steps, a method for polishing and flattening, e.g., a surface of a GaN substrate while irradiating the surface with light according to the present invention. First, as shown in FIG. 1A, a processing solution 14, comprising a neutral pH buffer solution containing Ga ions, is filled into a container 12 which, in its bottom, is provided with a polishing tool 10. The polishing tool 10 is, for example, composed of quartz glass which is an acidic solid catalyst having excellent light permeability. As the processing solution 14 is used, for example, a solution which is prepared by adding gallium nitrate to a phosphate buffer solution having a pH of 6.86 to bring Ga ions in the processing solution 14 near to saturation, in particular to a Ga ion concentration of not less than 10 ppm, followed by addition of a KOH solution to adjust the pH of the processing solution 14 in the range of 6.0 to 8.0. Instead of gallium nitrate, it is possible to add another gallium salt, such as gallium hydrochloride, gallium phosphate, gallium sulfate, or gallium hydroxide. Thereafter, a substrate holder 18, holding a GaN substrate 16 with a front surface (surface to be processed) facing downwardly, is lowered to immerse the GaN substrate 16 in the processing solution 14 in the container 12.

Figure 1B:
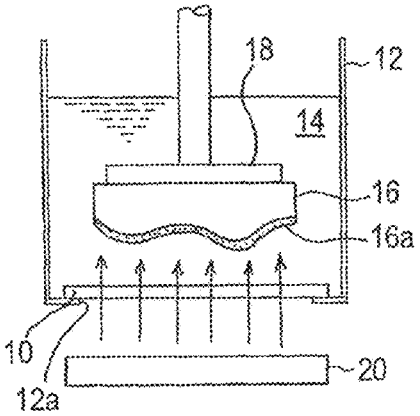

Next, as shown in FIG. 1B, light, preferably ultraviolet light is emitted from a light source 20 disposed below the container 12. Light passes though an opening 12*a*, formed in a bottom plate of the container 12, and through the interior of the polishing tool 10, and reaches the front surface (lower surface) of the GaN substrate 16. The wavelength of the irradiating light is preferably not more than the wavelength corresponding to the band gap of the object to be processed, GaN, i.e., not more than 365 nm (the band gap of GaN is 3.42 eV). Thus, GaN is oxidized by the light irradiation to produce Ga oxide ($Ga_2O_3$) 16*a* on the surface (lower surface) of the GaN substrate 16, as shown in FIG. 1B.

Figure 1C:
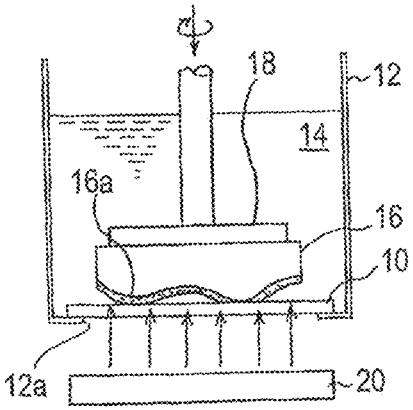

While thus producing the Ga oxide ($Ga_2O_3$) 16*a* on the surface (lower surface) of the GaN substrate 16 by irradiating the surface with light, the GaN substrate 16 held by the substrate holder 18 is rotated and lowered to bring the surface of the Ga oxide 16*a* into contact with the surface of the polishing tool 10 at a relatively low pressure, e.g., about 0.01 to 1.0 kgf/cm$^2$, as shown in FIG. 1C. By this operation, the Ga oxide 16*a* formed in those portions of the substrate surface which are in contact with the polishing tool 10, i.e., formed at the tops of raised portions in the surface of the GaN substrate 16 having surface irregularities, is selectively processed and removed. As described above, the processing solution 14 comprises a neutral pH buffer solution containing Ga ions. Only a slight amount of Ga oxide 16*a* can dissolve in such solution. Therefore, the Ga oxide 16*a*, formed in recessed portions of the surface of the GaN substrate 16 having surface irregularities, can be prevented from dissolving in the processing solution 14.

Figure 1D:
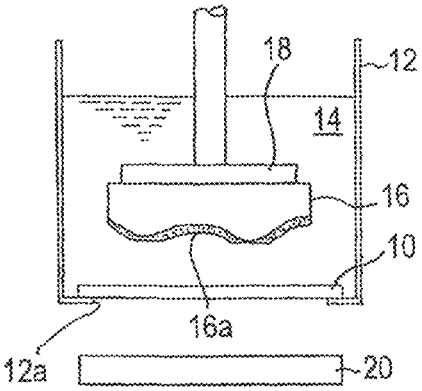

Accordingly, as shown in FIG. 1D, only the Ga oxide 16*a*, formed at the tops of raised portions of the surface of the GaN substrate 16, can be selectively removed while inhibiting dissolution of the Ga oxide 16*a*, formed in recessed portions of the surface of the GaN substrate 16, in the processing solution 14. This can shorten the time it takes to flatten the surface of the GaN substrate 16.

Especially when quartz glass, which is an acidic solid catalyst, is used for the polishing tool 10 as in this embodiment, a large amount of hydrogen ions ($H^+$) are generated at the surface of the polishing tool (quartz glass) 10. The Ga oxide 16*a* formed in those portions of the substrate surface which are in contact with the polishing tool (quartz glass) 10, i.e., formed at the tops of raised portions in the surface of the GaN substrate 16 having surface irregularities, reacts with the hydrogen ions ($H^+$) in accordance with the above-described chemical equation (2) and dissolves in the processing solution 14 at a high rate. This can promote the reaction of removal of the Ga oxide 16*a* at the tops of the raised portions in the surface of the GaN substrate 16, thereby further shortening the time it takes to process and flatten the substrate surface.

In order to prevent adhesion of the GaN substrate 16 to the surface of the polishing tool 10 and efficiently supply the processing solution 14 to the surface of the GaN substrate 16, it is preferred that the polishing tool 10 have a plurality of concentric, radial, spiral or lattice-shaped grooves in the surface.

Further, it is preferred to roughen a surface area of the polishing tool 10 which comes into contact with or close proximity to the GaN substrate 16, e.g., by sandblasting, or to produce a fine pattern in the surface area, e.g., by dicing. This can prevent the formation of a layer (lubricating fluid film) of the processing solution 14, which would hinder polishing, in a gap between the polishing tool 10 and the surface of the GaN substrate 16.

Though in this embodiment quartz glass, which is an acidic solid catalyst, is used for the polishing tool 10, it is also possible to use a basic solid catalyst. It is generally possible to use a polishing tool 10 which has an acidic or basic solid catalyst layer at least in a surface area which comes into contact with or close to a substrate.

The solid catalyst may be any of a non-woven fabric having an ion exchange function, a resin having an ion exchange function, a metal having an ion exchange function, and an acidic or basic metal oxide. Examples of the acidic or basic metal oxide include iron oxide, nickel oxide, cobalt oxide, tungsten oxide, ceramics such as alumina, zirconia and silica (silicon oxide), and glasses such as sapphire, quartz and zirconia.

The processing solution 14 preferably contains metal oxide particles, diamond particles, or catalyst particles whose surfaces are modified with an acidic or basic functional group, or a mixture of these particles. The use of such particles can more efficiently remove the Ga oxide 16*a*, thereby further shortening the time it takes to process and flatten a substrate surface. Examples of the metal oxide include silica ($SiO_2$) ceria ($CeO_2$), alumina ($Al_2O_3$), zirconia ($ZrO_2$), tungsten oxide ($WO_2$), chromium oxide ($Cr_2O_3$) and manganese dioxide ($MnO_2$).

The catalyst particles whose surfaces are modified with an acidic or basic functional group may be exemplified by styrene resin or fluororesin particles whose surfaces are modified with a functional group, such as a sulfa group, a carboxyl group or an amino group.

Further, the processing solution 14 preferably contains an oxidizing agent. The use of an oxidizing agent can promote the Ga oxide 16*a*-producing reaction, thereby further shortening the time it takes to process and flatten a surface of a substrate.

Specific examples of the oxidizing agent include hydrogen peroxide water, ozone water, persulfates such as potassium persulfate and ammonium persulfate, permanganates such as potassium permanganate, perchromates such as potassium prechromate, vanadates such as ammonium vanadate, sodium vanadate and potassium vanadate, and iodates such as sodium orthoperiodate and sodium metaperiodate.

According to the polishing method of this embodiment, only those portions of the Ga oxide 16*a*, which are in contact with the polishing tool 10, are selectively processed. Thus, it becomes possible to process and flatten the surface of the GaN substrate 16 using the surface of the polishing tool 10 as a processing reference plane.

Though in this embodiment the surface GaN of the GaN substrate 16 is oxidized by irradiating the substrate surface with light, preferably ultraviolet light, emitted from the light source 20, it is also possible to oxidize the surface GaN of the GaN substrate 16 by applying a voltage between the polishing tool 10 and the GaN substrate 16. It is preferred to use both the light irradiation and the voltage application.

A description will now be given of an experiment (demonstration experiment) which was conducted to demonstrate the fact that the use, as the processing solution 14, of a neutral pH buffer solution containing Ga ions can inhibit dissolution of Ga oxide ($Ga_2O_3$) in the processing solution 14.

[Demonstration Experiment 1]

Figure 2:
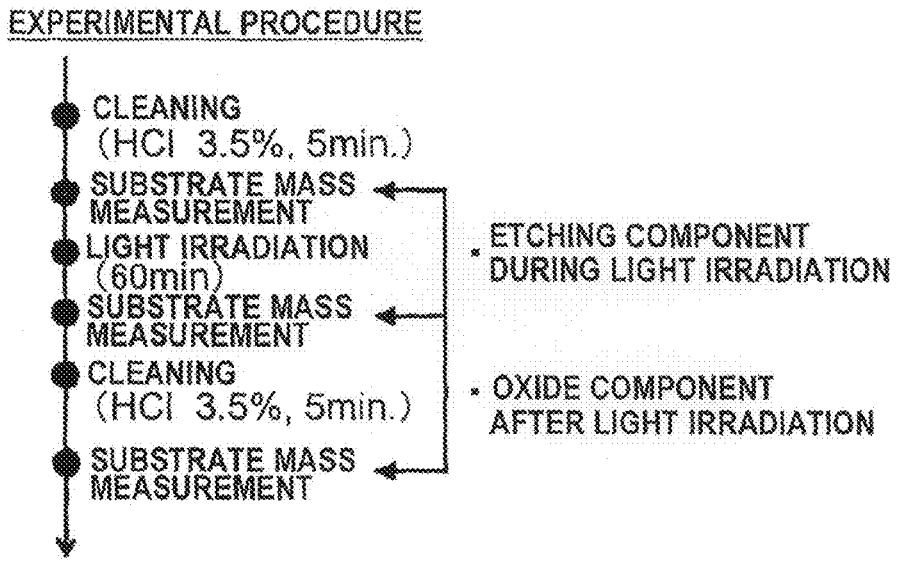
FIG. 2 is a diagram illustrating the procedure of Demonstration Experiment 1.

FIG. 2 shows the procedure of the experiment. As shown in FIG. 2, a GaN substrate was cleaned with an aqueous solution of 3.5% HCl for 5 minutes. The mass (mass 1) of the GaN substrate was then measured. Thereafter, the GaN substrate was placed in a phosphate buffer solution, and a surface of the GaN substrate was irradiated with light for 60 minutes to produce a Ga oxide on the surface. The mass (mass 2) of the GaN substrate was then measured. Further, "etching component during light irradiation" was determined from the mass difference (mass 2−mass 1). Next, the GaN substrate was cleaned with an aqueous solution of 3.5% HCl for 5 minutes, followed by measurement of the mass (mass 3) of the GaN substrate. "Oxide component after light irradiation" was determined from the mass difference (mass 3−mass 2).

The "etching component during light irradiation" indicates the mass of Ga oxide that dissolved in the phosphate buffer solution during the light irradiation, and the "oxide component after light irradiation" indicates the mass of Ga oxide that dissolved in the aqueous solution of 3.5% HCl during the cleaning of the substrate with the HCl solution after the light irradiation.

Figure 3:
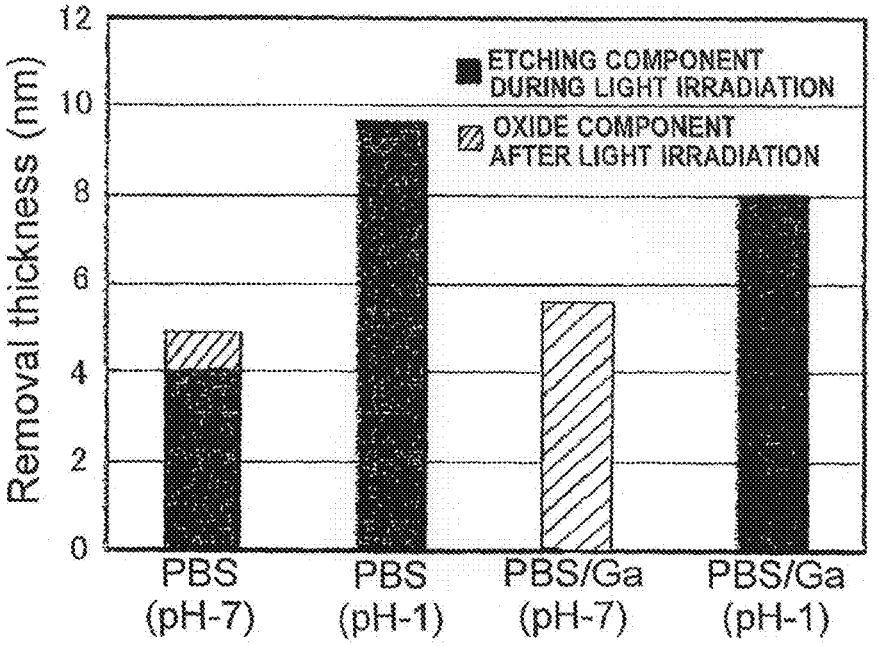
FIG. 3 is a graph showing the results of Demonstration Experiment 1.

The above test was conducted using as the "phosphate buffer solution" various types of phosphate buffer solutions. The results are shown in FIG. 3 in which "PBS (pH-7)" represents when a neutral (pH 7) phosphate buffer solution was used; "PBS (pH-1)" represents when an acidic (pH 1) phosphate buffer solution is used; "PBS/Ga (pH-7)" represents when a neutral (pH 7) phosphate buffer solution containing 10 ppm of Ga ions was used; and "PBS/Ga (pH-1)" represents when an acidic (pH 1) phosphate buffer solution containing 10 ppm of Ga ions was used.

As can be seen from the data in FIG. 3, when the GaN substrate was placed in the neutral (pH 7) phosphate buffer solution containing 10 ppm of Ga ions ("PBS/Ga (pH-7)") and the surface of the substrate was irradiated with light, the Ga oxide produced by the light irradiation did not dissolve in the phosphate buffer solution, and dissolved in the aqueous solution of 3.5% HCl when the substrate was cleaned with the HCl solution after the light irradiation. In the case of the other three types of phosphate buffer solutions, the Ga oxide produced by the light irradiation partly or wholly dissolved in the phosphate buffer solution. The experimental results thus indicate that the use, as a processing solution, of a neutral (pH 7) buffer solution containing Ga ions (e.g., 10 ppm) can inhibit dissolution of Ga oxide, produced on a surface of a GaN substrate, in the processing solution.

[Demonstration Experiment 2]

Figure 4:
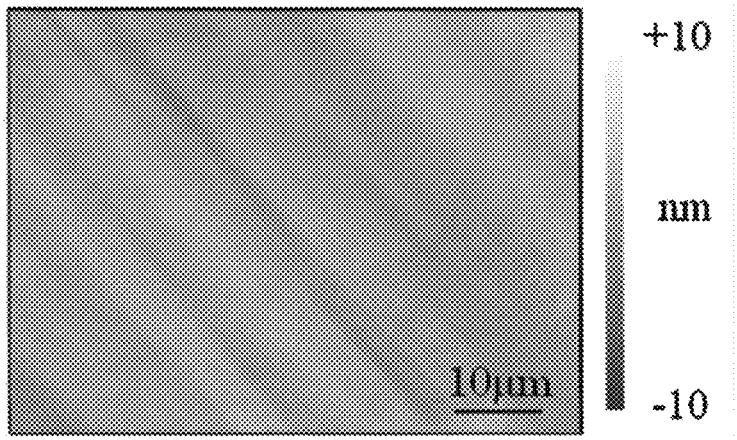
FIG. 4 is a diagram showing an optical microscopic image of a surface of a GaN substrate before light irradiation in Demonstration Experiment 2.
Figure 5:
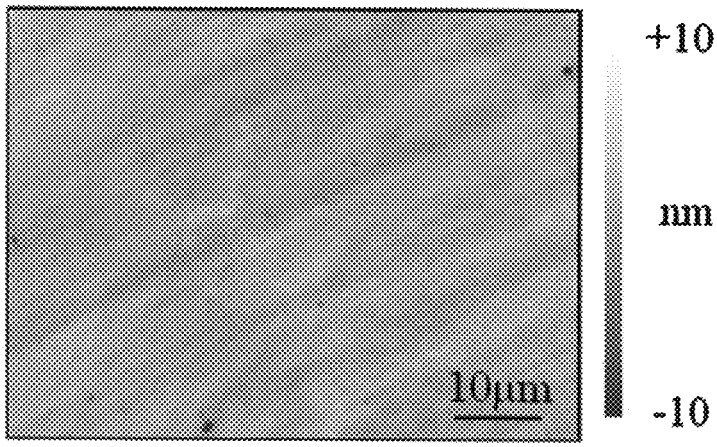
FIG. 5 is a diagram showing an optical microscopic image of the surface of the GaN substrate after light irradiation in Demonstration Experiment 2.

A GaN substrate was placed in a phosphate buffer solution containing 10 ppm of Ga ions and having a pH of 6.86, and a surface of the GaN substrate was irradiated with light for 3 hours. The GaN substrate surface was observed using an optical microscope before and after the light irradiation. FIG. 4 shows an optical microscopic image of the GaN substrate surface before the light irradiation, and FIG. 5 shows an optical microscopic image of the GaN substrate surface after the light irradiation. As can be seen from FIGS. 4 and 5, there is no significant change in the surface state of the GaN substrate, with no worsening of the surface roughness, before and after the light irradiation.

Figure 6:
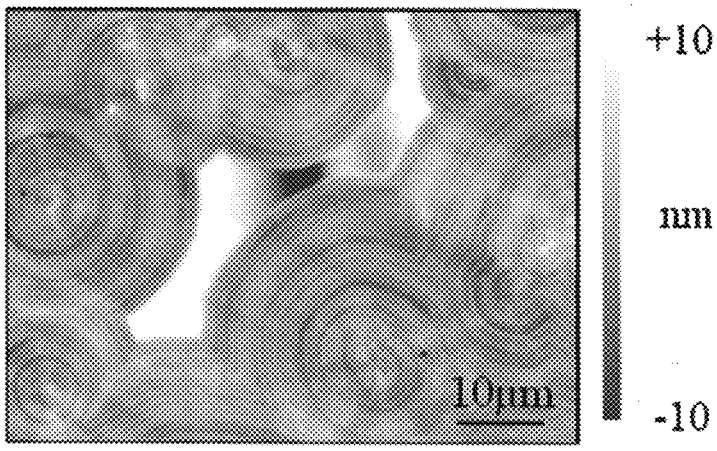
FIG. 6 is a diagram showing an optical microscopic image of a surface of a GaN substrate after light irradiation in Comparative Experiment.

A comparative experiment was conducted in which a GaN substrate was placed in a phosphate buffer solution containing no Ga ions and having a pH of 6.86, and a surface of the GaN substrate was irradiated with light for 3 hours. The GaN substrate surface was observed using an optical microscope after the light irradiation. FIG. 6 shows an optical microscopic image of the GaN substrate surface after the light irradiation. As can be seen from FIG. 6, when a GaN substrate was placed in a phosphate buffer solution containing no Ga ions and a surface of the GaN substrate was irradiated with light, Ga oxide on the substrate surface dissolved in the solution, and hexagonal surface structures of a crystalline form called facet was formed. As will be appreciated from FIGS. 4 and 6, in the case where the comparative buffer solution containing no Ga ions is used, a surface of a GaN substrate is etched when irradiated with light, resulting in worsening of the surface roughness. The above experimental results thus demonstrate that the inclusion of Ga ions in a neutral phosphate buffer solution can inhibit dissolution of Ga oxide in the solution.

Figure 7:
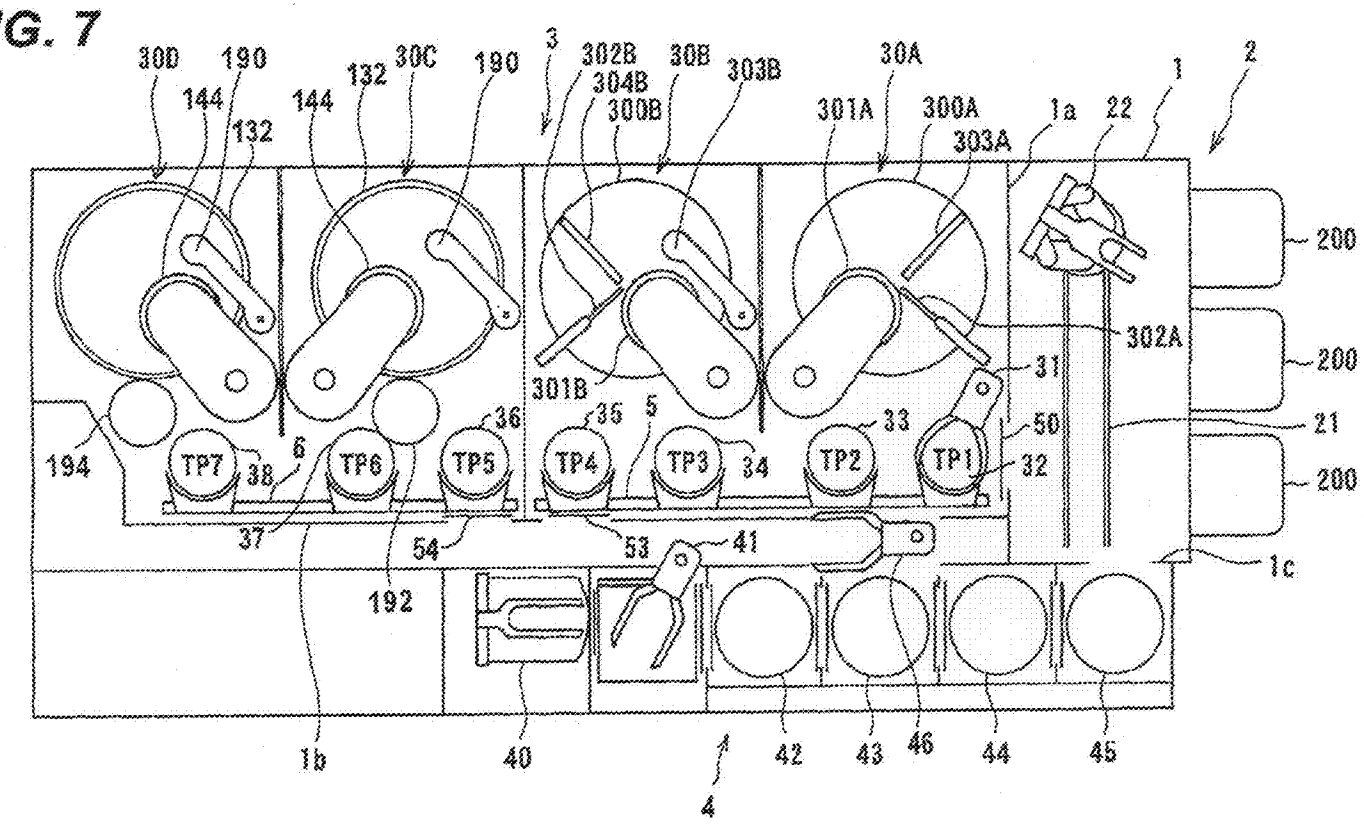
FIG. 7 is a plan view showing the overall construction of a flattening system incorporating a polishing apparatus according to an embodiment of the present invention.

FIG. 7 is a plan view showing the overall construction of a flattening system incorporating a polishing apparatus according to an embodiment of the present invention. As shown in FIG. 7, this flattening system includes a substantially rectangular housing 1 whose interior is divided by partition walls 1*a*, 1*b*, 1*c* into a loading/unloading section 2, a surface removal processing section 3 and a cleaning section 4. The loading/unloading section 2, the surface removal processing section 3 and the cleaning section 4 are independently fabricated and independently evacuated.

The loading/unloading section 2 includes at least two (e.g., three as shown) front loading sections 200 on which substrate cassettes, each storing a number of substrates (objects to be polished), are placed. The front loading sections 200 are arranged side by side in the width direction (perpendicular to the long direction) of the flattening system. Each front loading section 200 can receive thereon an open cassette, a SMIF (standard manufacturing interface) pod or a FOUP (front opening unified pod). The SMIF and FOUP are a hermetically sealed container which can house a substrate cassette therein and can keep the interior environment independent of the exterior environment by covering with a partition.

A moving mechanism 21, extending along the line of the front loading sections 200, is provided in the loading/unloading section 2. On the moving mechanism 21 is provided a first transfer robot 22 as a first transfer mechanism, which is movable along the direction in which substrate cassettes are arranged. The first transfer robot 22 can reach the substrate cassettes placed in the front loading sections 200 by moving on the moving mechanism 21. The first transfer robot 22 has two hands, an upper hand and a lower hand, and can use the two hands differently, for example, by using the upper hand when returning a processed substrate to a substrate cassette and using the lower hand when transferring an unprocessed substrate.

The loading/unloading section 2 is an area that needs to be kept in the cleanest environment. Accordingly, the interior of the loading/unloading section 2 is constantly kept at a higher pressure than any of the outside of the apparatus, the surface removal processing section 3 and the cleaning section 4. Furthermore, a filter-fan unit (not shown) having an air filter, such as an HEPA filter or a ULPA filter, is provided above the moving mechanism 21 for the first transfer robot 22. Clean air, from which particles, vapor and gas have been removed, continually blows off downwardly through the filter-fan unit.

The surface removal processing section 3 is an area where removal processing of a surface (surface to be processed) of a substrate is carried out. In this embodiment, the surface removal processing section 3 includes a lapping apparatus 30A as a first surface removal processing apparatus, a CMP apparatus 30B as a second surface removal processing apparatus and two polishing apparatuses 30C, 30D according to an embodiment of the present invention as third (final) surface removal processing apparatuses. The lapping apparatus 30A, the CMP apparatus 30B and the polishing apparatuses 30C, 30D are arranged along the long direction of the flattening system.

The lapping apparatus 30A includes a platen 300A having a lapping surface, a top ring 301A for detachably holding a substrate and pressing the substrate against the platen 300A, a lapping liquid supply nozzle 302A for supplying a lapping liquid, such as a diamond slurry or a colloidal silica slurry, to the platen 300A, and a pure water supply nozzle 303A for supplying pure water to a surface of the platen 300A. During lapping by the lapping apparatus 30A, the lapping liquid (slurry) is supplied from the lapping liquid supply nozzle 302A onto the platen 300A, and a substrate as a object to be polished is held by the top ring 301A and pressed against the platen 300A to carry out lapping of the surface of the substrate.

The lapping apparatus 30A is mainly directed to obtaining a large processing amount while enhancing the flatness of a substrate surface in the process of flattening, e.g., a substrate surface having relatively large initial irregularities into a desired flatness. The lapping apparatus 30A can therefore be omitted when a substrate to be processed does not have large initial irregularities in a surface.

The CMP apparatus 30B includes a polishing table 300B having a polishing surface, a top ring 301B for detachably holding a substrate and pressing the substrate against the polishing table 300B to polish the substrate, a polishing liquid supply nozzle 302B for supplying a polishing liquid or a dressing liquid (e.g., water) to the polishing table 300B, a dresser 303B for carrying out dressing of the polishing surface of the polishing table 300B, and an atomizer 304B for spraying a mixed fluid of a liquid (e.g., pure water) and a gas (e.g., nitrogen gas) in a mist form onto the polishing surface of the polishing table 300B from one or a plurality of nozzles.

A polishing cloth, abrasive grains (fixed abrasive grains), or the like, constituting a polishing surface for polishing a substrate surface, is attached to the upper surface of the polishing table 300B of the CMP apparatus 30B. During polishing by the polishing apparatus 30B, a polishing liquid is supplied from the polishing liquid supply nozzle 302B onto the polishing surface of the polishing table 300B, and a substrate as an object to be polished is held by the top ring 301B and pressed against the polishing surface to carry out polishing of the surface of the substrate.

The CMP apparatus 30B is to enhance the flatness of a substrate surface while processing the substrate at a high processing rate to obtain a large processing amount. Thus, the CMP apparatus 30B, when used in combination with the above-described lapping apparatus 30A, can effectively flatten a substrate surface having relatively large initial irregularities into a desired flatness. Depending on the degree of surface irregularities of the substrate to be processed, etc., however, the CMP apparatus 30B may be omitted.

Figure 8:
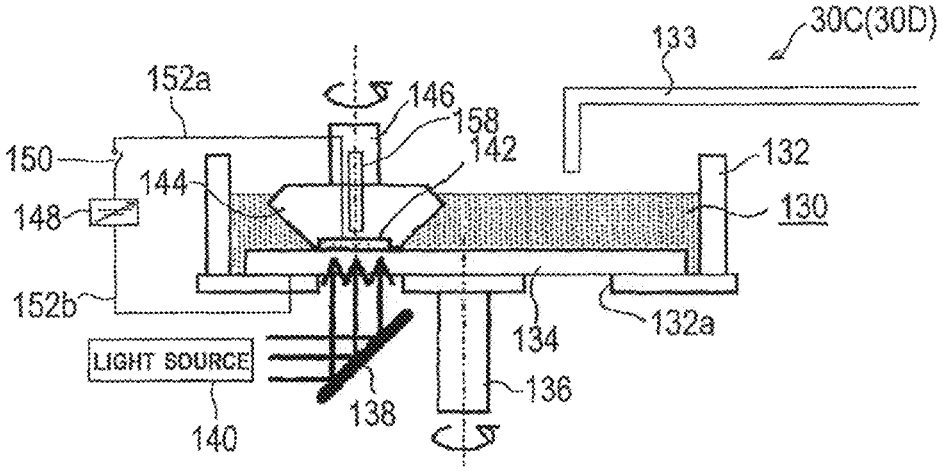
FIG. 8 is a diagram schematically showing the polishing apparatus shown in FIG. 7.

As shown in FIG. 8, the polishing apparatuses 30C, 30D according to the present invention each include a container 132 for holding therein a processing solution 130 comprising a neutral pH buffer solution containing Ga ions. Above the container 132 is disposed a processing solution supply nozzle (processing solution supply section) 133 for supplying the processing solution 130 into the container 132. As the processing solution 130 may be used a solution which is prepared by adding Ga ions, e.g., in an amount of not less than 10 ppm, to a phosphate buffer solution, e.g., having a pH of 6.86 to bring Ga ions in the processing solution 130 near to saturation. The pH of the neutral pH buffer solution (at 25° C.) is, for example, 6.0 to 8.0.

A polishing tool 134 is mounted on the bottom of the container 132, so that the polishing tool 134 becomes immersed in the processing solution 130 when the processing solution 130 is filled into the container 132. The polishing tool 134 is, for example, composed of quartz glass which is an acid solid catalyst having excellent light permeability. As described above, it is also possible to use a basic solid catalyst for the polishing tool 134. Further, it is possible to use one having an acidic or basic solid catalyst layer only in a surface of the polishing tool 134.

The container 132 is coupled to an upper end of a rotating shaft 136. The bottom plate of the container 132 has a ring-shaped opening 132*a* formed around the rotating shaft 136 and closed by the polishing tool 134. A reflective plate 138, having the 45° slant, is disposed right below the opening 134*a*. Further, a light source 140 for emitting light, preferably ultraviolet light, is disposed lateral to the reflective plate 138. Light, preferably ultraviolet light, emitted from the light source 140, reflects off the reflective plate 138, passes through the opening 132*a* of the container 132, permeates through the interior of the polishing tool 134 and reaches above the polishing tool 134.

Right above the reflective plate 138 is disposed a substrate holder 144 for detachably holding a substrate 142, e.g., a GaN substrate, with a front surface facing downwardly. The substrate holder 144 is coupled to a lower end of a main shaft 146 that is rotatable and vertically movable.

In this embodiment, the rotating shaft 136 for rotating the container 132 and the main shaft 146 for rotating the substrate holder 144 constitute a movement mechanism for moving the polishing tool 134 and the substrate (GaN substrate) 142, held by the substrate holder 144, relative to each other. However, it is also possible to provide only one of them.

The polishing apparatus of this embodiment is also provided with a power source 148 for applying a voltage between the substrate 142, held by the substrate holder 144, and the polishing tool 134. A switch 150 is interposed in a conducting wire 152*a* extending from the positive pole of the power source 148.

In this embodiment, processing of the substrate 142 is carried out in an immersion manner: the container 132 is filled with the processing solution 130 and the polishing tool 134 and the substrate 142 held by the substrate holder 144 are kept immersed in the processing solution 130 during processing. It is also possible to employ a dripping manner in which the processing solution 130 is supplied between the substrate 142 and the polishing tool 134 by dripping the processing solution 130 from the processing solution supply nozzle 133 onto the surface of the polishing tool 134, so that processing of the substrate 142 is carried out in the presence of the processing solution 130.

Figure 9:
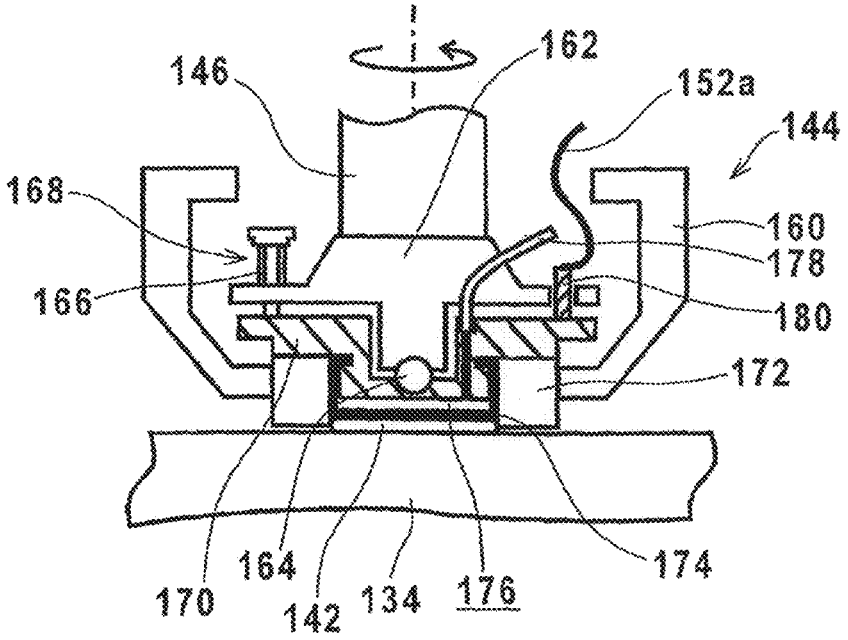
FIG. 9 is an enlarged cross-sectional view of a substrate holder of the polishing apparatus shown in FIG. 8.

As shown in FIG. 9, the substrate holder 144 has a cover 160 for preventing intrusion of the processing solution 130. Inside the cover 160, a metal holder body 170 is coupled, via a rotation transmission section 168 including a universal joint 164 and a spring 166, to a drive flange 162 that is coupled to the lower end of the main shaft 146.

A retainer ring 172 is vertically movably disposed around the lower portion of the holder body 170. A conductive rubber 174 is mounted to a lower surface (substrate holding surface) of the holder body 170 such that a pressure space 176 can be formed between the lower surface of the holder body 170 and the conductive rubber 174. An air introduction pipe 178 is connected to the pressure space 176 via an air introduction passage extending in the holder body 170. The flange portion of the metal holder body 170 is provided with an extraction electrode 180 to which is connected the conducting wire 152*a* extending from the positive pole of the power source 148.

In order to prevent wear of the surface of the retainer ring 172 by making into contact with the polishing tool 134 to thereby prevent the surface material of the retainer ring 172 from adhering to the surface of the polishing tool 134, at least the surface portion of the retainer ring 172, which comes into contact with the polishing tool 134, is preferably made of a glass material, such as quartz, sapphire or zirconia, or a ceramic material such as alumina, zirconia or silicon carbide. The conductive rubber 174 is, for example, a conductive chloroprene rubber, a conductive silicone rubber or a conductive fluororubber.

When the back surface of the substrate 142 is held, e.g., by attraction, on the lower surface (substrate holding surface) of the holder body 170 of the substrate holder 144, the conductive rubber 174 comes into contact with the back surface of the substrate 142 to feed electricity to the back surface. While maintaining the electricity feeding to the back surface of the substrate 142, air can be introduced into the pressure space 176 so as to press the substrate 142 against the polishing tool 134.

The substrate holder 144 can thus hold the substrate 142 while feeding electricity to the substrate 142 in a simple manner at a low resistance. The substrate holder 144 is preferably configured to be capable of filling a polar conductive grease between the conductive rubber 174 and the substrate 142 when bringing the substrate 142 into contact with the conductive rubber 174 upon holding of the substrate 142 on the substrate holder 144.

Figure 10:
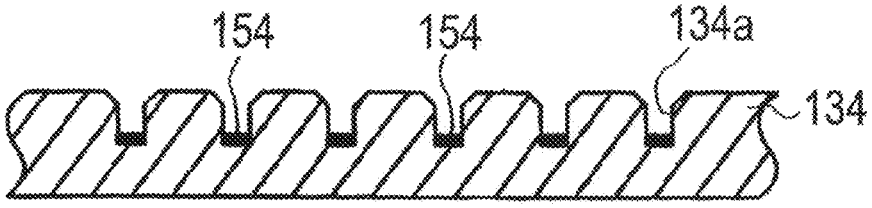
FIG. 10 is an enlarged cross-sectional view of a polishing tool of the polishing apparatus shown in FIG. 8.

As shown in FIG. 10, a large number of grooves 134*a* are provided in an upper surface of the polishing tool 134 in an area corresponding to the opening 132*a* of the container 132. A vapor-deposited metal film 154 is formed in bottoms of the grooves 134*a*. To the metal film 154 is connected a conducting wire 152*b* extending from the negative pole of the power source 148. The metal film 154 is preferably made of platinum or gold, which is corrosion-resistant. Though the grooves 134*a* provided in the upper surface of the polishing tool 134 are preferably arranged in concentric circles, it is also possible to arrange the grooves in a spiral, radial or lattice-shaped configuration.

Figure 11:
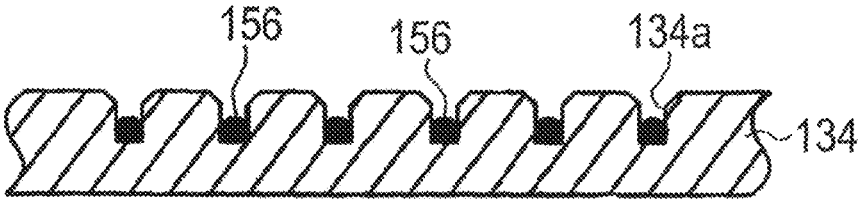
FIG. 11 is an enlarged cross-sectional view showing another polishing tool.

As shown in FIG. 11, it is also possible to provide a metal wire 156 of, e.g., gold or platinum in the bottoms of the grooves 134 provided in the upper surface of the polishing tool 134.

Figure 12:
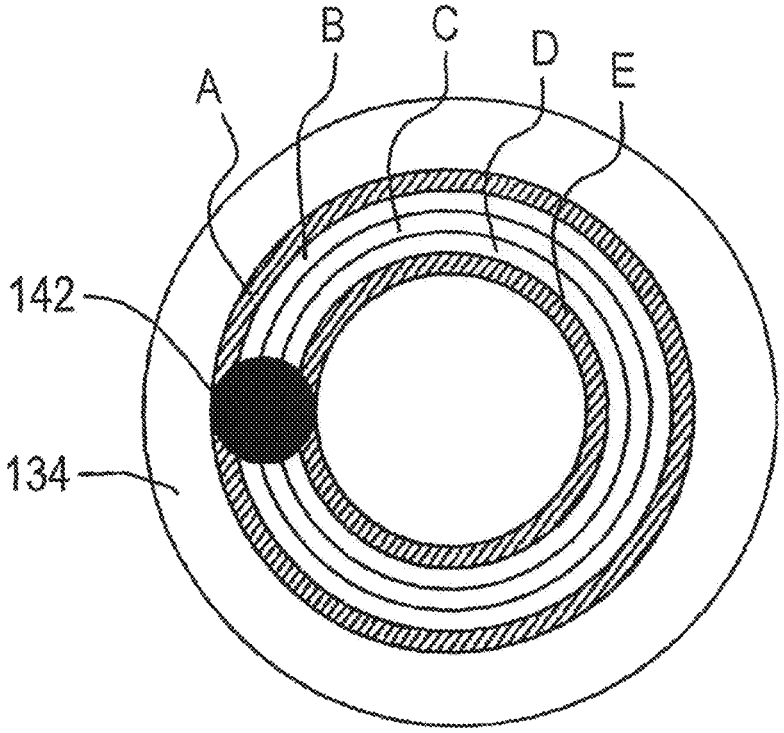
FIG. 12 is a plan view showing yet another polishing tool.

As shown in FIG. 12, it is preferred to divide the grooves 134*a*, provided in the upper surface of the polishing tool 134, e.g., into zones A to E in the radial direction of the substrate 142 to be held by the substrate holder 144 and brought into contact with the polishing tool 134, and to individually control the voltages applied to the zones A to E. This makes it possible to control the polishing rate individually for the respective zones A to E.

A heater 158 (see FIG. 8), embedded in the substrate holder 144 and extending into the rotating shaft 146, is provided as a temperature control mechanism for controlling the temperature of the substrate 142 held by the substrate holder 144. Above the container 132 is disposed the processing solution supply nozzle 133 for supplying the processing solution 130, which is controlled at a predetermined temperature by a heat exchanger as a temperature control mechanism, into the container 132. Furthermore, a fluid passage (not shown) as a temperature control mechanism for controlling the temperature of the polishing tool 134 is provided in the interior of the polishing tool 134.

As is known by the Arrhenius equation, the higher the reaction temperature of a chemical reaction is, the higher is the reaction rate. Thus, by controlling at least one of the temperature of the substrate 142, the temperature of the processing solution 130 and the temperature of the polishing tool 134 so as to control the reaction temperature, the processing rate can be adjusted and the stability of the processing rate can be enhanced.

As shown in FIG. 7, the polishing apparatuses 30C, 30D are each provided with a conditioning mechanism (conditioner) 190, e.g., comprised of a polishing pad, for conditioning the surface (upper surface) of the polishing tool 134 so that it has desired flatness and appropriate roughness. The surface (upper surface) of the polishing tool 134 is conditioned by the conditioning mechanism (conditioner) 190 so that it has a PV (peak-to-valley) flatness of about 0.1 to 1 μm. During the conditioning of the polishing tool 134, an abrasive-containing slurry may be supplied to the surface of the polishing tool 134, as necessary.

Figures 13A, 13B:
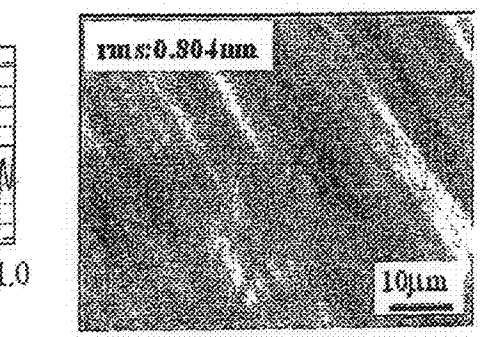
FIG. 13A is a diagram showing the cross-sectional configuration of a surface of a substrate after it is polished by a polishing tool having a PV surface flatness of more than 1 μm.
FIG. 13B is a diagram showing an optical microscopic image of the surface of the substrate.
Figure 14B:
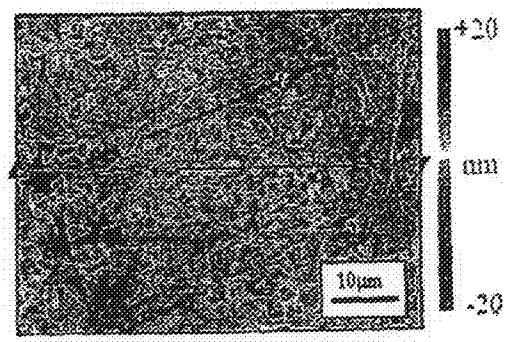
FIG. 14B is a diagram showing an optical microscopic image of the surface of the substrate.
Figure 14A:
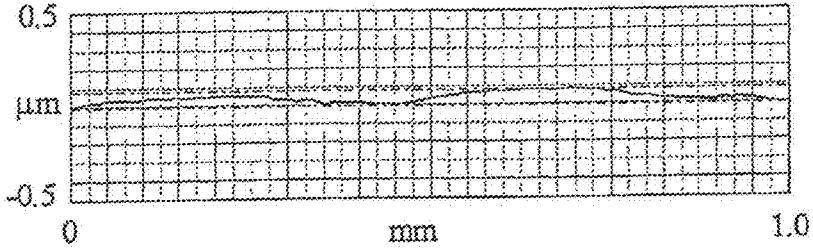
FIG. 14A is a diagram showing the cross-sectional configuration of a surface of a substrate after it is polished by a polishing tool having a PV surface flatness of less than 0.1 μm.

When a surface of a substrate is polished by using a polishing tool having a PV surface flatness of more than 1 μm, as shown in FIG. 13A, the surface of the substrate can be flatted (surface roughness RMS of the polished surface of the substrate is 0.804 μm). However, as shown in FIG. 13B, streaks will appear on the polished surface of the substrate. On the other hand, when a surface of a substrate is polished by using a polishing tool having a PV surface flatness of less than 0.1 μm, as shown in FIGS. 14A and 14B, the surface of the substrate will not be sufficiently processed due to the lubricating action of a processing solution present between the surface of the polishing tool and the surface of the substrate.

Figure 15A:
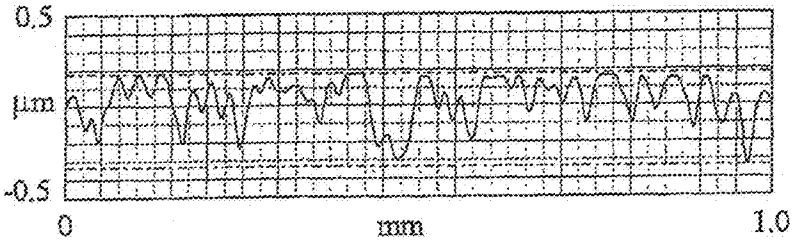
FIG. 15A is a diagram showing the cross-sectional configuration of a surface of a substrate after it is polished by a polishing tool having a PV surface flatness of 0.1 to 1 μm.
Figure 15B:
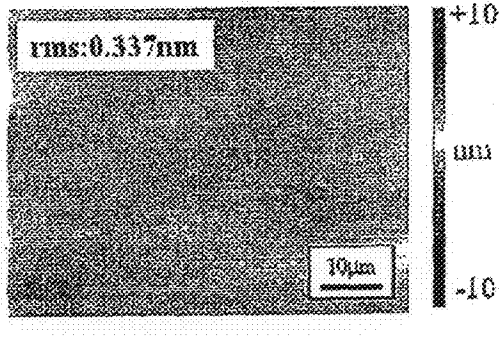
FIG. 15B is a diagram showing an optical microscopic image of the surface of the substrate.

In contrast, when a surface of a substrate is polished by using a polishing tool having a PV surface flatness in the range of 0.1 to 1 μm, as shown in FIG. 15A, the surface of the substrate can be flatted (surface roughness RMS of the polished surface of the substrate is 0.337 μm). In addition, as shown in FIG. 15B, the polished surface of the substrate will be free of streaks.

In operation of the polishing apparatus 30C or 30D, the substrate 142, such as a GaN substrate, is held, with a front surface (surface to be processed) facing downwardly, by the substrate holder 144 lying above the container 132, and the substrate holder 144 is then lowered to immerse the substrate 142 in the processing solution 130 held in the container 132. In the presence of the processing solution 130 between the substrate 142 and the polishing tool 134, light, preferably ultraviolet light is radiated from the light source 140 onto the front surface (lower surface) of the substrate 142. The wavelength of the irradiating light is preferably not more than the wavelength corresponding to the band gap of the substrate 142, i.e., not more than 365 nm in the case of a GaN substrate (the band gap of GaN is 3.42 eV). In the case of a GaN substrate, GaN is thus oxidized by the light irradiation to produce Ga oxide ($Ga_2O_3$) on the surface of the GaN substrate.

On the other hand, the switch 150 of the power source 148 is turned on to apply a voltage between the polishing tool 134 and the substrate 142, held by the substrate holder 144, such that the polishing tool 134 serves as a cathode. In the case of a GaN substrate, the voltage application can promote the production of Ga oxide ($Ga_2O_3$) on the surface of the GaN substrate.

Next, while radiating light, preferably ultraviolet light, from the light source 140 and applying a voltage between the polishing tool 134 and the substrate 142, the rotating shaft 136 is rotated to rotate the polishing tool 134 and, at the same time, the substrate holder 144 is rotated to rotate the substrate 142 and lowered to bring the surface of the substrate 142 into contact with the surface of the polishing tool 134 preferably at a pressure of about 0.01 to 1.0 kgf/cm$^2$. If the pressure is lower than 0.01 kgf/cm$^2$, it is possible that warpage of the substrate 142 cannot be corrected and the entire substrate 142 cannot be polished uniformly. If the pressure is higher than 1.0 kgf/cm$^2$, a mechanical defect can be produced on the surface of the substrate 142. By this operation, Ga oxide formed in those portions of the surface of the substrate (GaN substrate) 142, which are in contact with the polishing tool 134, i.e., formed at the tops of raised portions in the surface of the substrate 142 having surface irregularities, is selectively processed and removed whereby the surface of the substrate 142 is flattened.

After completion of the processing of the surface of the substrate 142, the radiation of light, preferably ultraviolet light, from the light source 140 and the voltage application between the polishing tool 134 and the substrate 142 are stopped, and the substrate holder 144 is raised and then the rotation of the substrate 142 is stopped. The processed substrate 142 is then transported for the next stage.

Ga oxide on the surface of the substrate 142 is thus polished while forming a Ga oxide film on the surface of the substrate 142 both by irradiation of the surface of the substrate 142 with light and by application of a bias voltage to the substrate 142. This can ensure a sufficient polishing rate and, even when there is a large damaged portion in the surface of the substrate 142, can securely remove the damaged portion.

However, when a high bias voltage is applied to the surface of the substrate 142 to increase the oxidation rate, the oxide film can grow faster than it is removed, resulting in excessive growth of the oxide film and attendant roughening of the surface of the substrate 142.

In view of this, it is possible to carry out a first polishing step in the above-described manner, i.e., by polishing Ga oxide on the surface of the substrate 142 while forming the Ga oxide film on the substrate surface both by irradiation of the substrate surface with light and by application of a bias voltage to the substrate 142, and to subsequently carry out a second polishing step without the application of the bias voltage while irradiating the surface of the substrate 142 with light.

According to this two-step polishing method, the first polishing step can ensure a sufficient polishing rate and, even when there is a large damaged portion in the surface of the substrate 142, can securely remove the damaged portion. Further, the second polishing step can prevent excessive growth of a Ga oxide film on the surface of the substrate 142 and can enhance the flatness of the processed surface of the substrate 142.

Figure 16A:
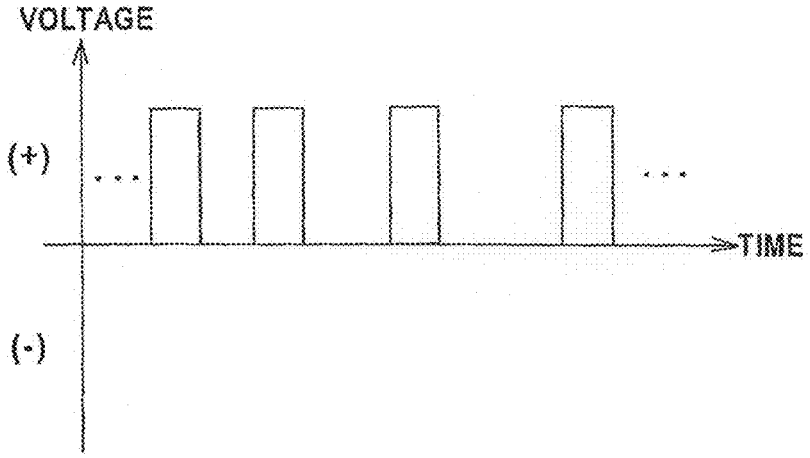
FIGS. 16A and 16B are diagrams illustrating different pulse voltages to be applied to a substrate.

When shifting the first polishing step to the second polishing step, the bias voltage applied to the substrate 142 may be gradually decreased. Alternatively, a pulse voltage, which repeats "on" and "off" at intervals of, e.g., 0.1 to 10 seconds, may be used as the bias voltage and the application off time of the pulse voltage may be gradually increased, as shown in FIG. 16A.

Thus, processing of the surface of the substrate 142 can be carried out while applying a sufficiently high bias voltage to the substrate 142 so as to uniformly oxidize the entire surface of the substrate 142 and form a thin oxide film on the entire substrate surface without being influenced by a damaged portion in the substrate surface. By subsequently gradually lowering the applied bias voltage, or by using a pulse voltage as the bias voltage and gradually increasing the application off time of the pulse voltage, processing can be continued while inhibiting excessive growth of the oxide film.

Figure 16B:
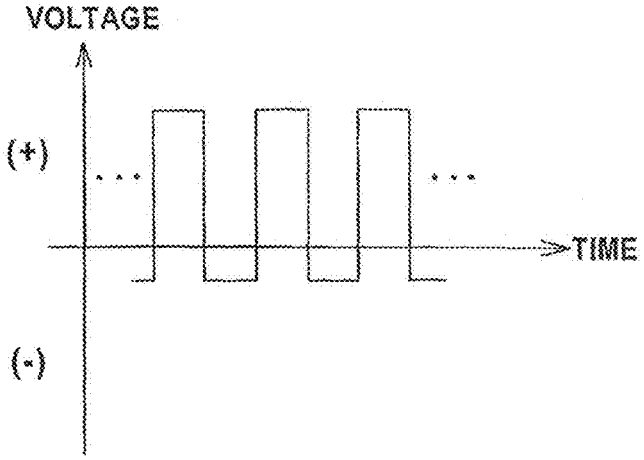

It is also possible to use a bias voltage which repeats application of a positive voltage and application of a reverse voltage to the substrate 142 for a predetermined interval, as shown in FIG. 16B, so that even when an oxide film is formed excessively on the surface of the substrate 142 by the application of a positive bias voltage to the substrate 142, the oxide film can be etched away by the application of a reverse voltage to the substrate 142.

Though in the above embodiment the first polishing step and the second polishing step are carried out successively in the same apparatus to increase the throughput, it is also possible to use separate apparatuses to carry out the first and second polishing steps.

Returning to FIG. 7, between the lapping apparatus 30A and CMP apparatus 30B and the cleaning section 4 is disposed a first linear transporter 5 as a second (translatory) transfer mechanism for transferring a substrate between four transferring positions (a first transferring position TP1, a second transferring position TP2, a third transferring position TP3, and a fourth transferring position TP4 in the order of distance from the loading/unloading section 2) along the long direction of the flattering system. A reversing machine 31 for reversing a substrate received from the first transfer robot 22 is disposed above the first transferring position TP1 of the first linear transporter 5, and a vertically-movable lifter 32 is disposed below the reversing machine 31. Further, a vertically-movable pusher 33 is disposed below the second transferring position TP2, a vertically-movable pusher 34 is disposed below the third transferring position TP3, and a vertically-movable lifter 35 is disposed below the fourth transferring position TP4.

Beside the polishing apparatuses 30C, 30D and adjacent to the first linear transporter 5 is disposed a second linear transporter 6 as a second (translatory) transfer mechanism for transferring a substrate between three transferring positions (fifth transferring position TP5, sixth transferring position TP6 and seventh transferring position TP7 in order of distance from the loading/unloading section 2) along the long direction of the flattering system. A vertically-movable lifter 36 is disposed below the fifth transferring position TP5, a pusher 37 is disposed below the sixth transferring position TP6, and a pusher 38 is disposed below the seventh transferring position TP7. Further, a pure water replacement section 192 including a tub and a pure water nozzle is disposed between the polishing apparatus 30C and the pusher 37, and a pure water replacement section 194 including a tub and a pure water nozzle is also disposed between the polishing apparatus 30D and the pusher 38.

As will be understood from the use of a slurry or the like during surface removal processing, the surface removal processing section 3 is the dirtiest area. In this system, therefore, discharge of air is performed around a removal processing site, such as a platen, so as to prevent particles in the surface removal processing section 3 from flying to the outside. Further, the internal pressure of the surface removal processing section 3 is made lower than the external pressure of the system and the internal pressures of the neighboring cleaning section 4 and loading/unloading section 2, thereby preventing particles from flying out. An exhaust duct (not shown) and a filter (not shown) are usually provided respectively below and above a removal processing site, such as a platen, so as to create a downward flow of cleaned air.

The cleaning section 4 is an area for cleaning a substrate. The cleaning section 4 includes a second transfer robot 40, a reversing machine 41 for reversing a substrate received from the second transfer robot 40, three cleaning units 42-44 each for cleaning the substrate, a drying unit 45 for rinsing the cleaned substrate with pure water and then spin-drying the substrate, and a movable third transfer robot 46 for transferring the substrate between the reversing machine 41, the cleaning units 42-44 and the drying unit 45. The second transfer robot 40, the reversing machine 41, the cleaning units 42-44 and the drying unit 45 are arranged in a line along the long direction of the flattering system, and the third transfer robot 46 is movably disposed between the first linear transporter 5 and the line of the second transfer robot 40, the reversing machine 41, the cleaning units 42-44 and the drying unit 45. A filter-fan unit (not shown) having an air filter is provided above the cleaning units 42-44 and the drying unit 45, and clean air, from which particles have been removed by the filter-fan unit, continually blows downward. The interior of the cleaning section 4 is constantly kept at a higher pressure than the surface removal processing section 3 to prevent inflow of particles from the surface removal processing section 3.

A shutter 50, located between the reversing machine 31 and the first transfer robot 22, is provided in the partition wall 1*a* surrounding the surface removal processing section 3. The shutter 50 is opened when transferring a substrate between the first transfer robot 22 and the reversing machine 31. Further, a shutter 53 located at a position facing the CMP apparatus 30B and a shutter 54 located at a position facing the polishing apparatus 30C are respectively provided in the partition wall 1*b* surrounding the surface removal processing section 3.

Processing for flattening a surface of a substrate by the flattening system having the above construction will now be described.

One substrate is taken by the first transfer robot 22 out of a substrate cassette mounted in one of the front loading sections 20, and the substrate is transferred to the reversing machine 31. The reversing machine 31 reverses the substrate 180° and then places the substrate on the lifter 32 at the first transferring position TP1. The top ring 301A of the lapping apparatus 30A receives the substrate from the lifter 32, and the lapping apparatus 30A carries out lapping of the surface of the substrate. In particular, in the lapping apparatus 30A, lapping of the substrate surface is carried out, e.g., at a processing rate of not more than several tens of μm/h while supplying a lapping liquid, such as a diamond slurry or a colloidal silica slurry, to the platen 300A, thereby removing the substrate surface in an amount corresponding to a thickness of about 10 μm and flattening the substrate surface. The depth of damage in the substrate surface after processing is about 1 μm. The substrate surface is rinsed with pure water, as necessary.

The substrate after lapping is transferred to the pusher 33 at the second transferring position TP2, and is then transferred to the third transferring position TP3 by the first linear transporter 5. The top ring 301B of the CMP apparatus 30B receives the substrate from the pusher 34 at the third transferring position TP3, and the CMP apparatus 30B carries out chemical mechanical polishing of the surface of the substrate. In particular, in the CMP apparatus 30B, chemical mechanical polishing of the substrate surface is carried out, e.g., at a processing rate of not more than several μm/h while supplying a polishing liquid, e.g., containing colloidal silica, to the polishing table 300B, thereby removing the substrate surface in an amount corresponding to a thickness of about several μm and further flattening the substrate surface. The depth of damage in the substrate surface after processing is about 10 nm. The substrate surface is rinsed with pure water, as necessary.

The substrate after CMP is transferred to the lifter 35 at the fourth transferring position TP4. The second transfer robot 40 receives the substrate from the lifter 35 and places the substrate on the lifter 36 at the fifth transferring position TP5. The second linear transporter 6 moves horizontally to transfer the substrate on the lifter 36 to one of the sixth transferring position TP6 and the seventh transferring position TP7. The substrate holder 144 of the polishing apparatus 30C or 30D receives the substrate from the pusher 37 or 38, and the polishing apparatus 30C or 30D carries out polishing of the surface of the substrate.

For the substrate which has undergone polishing in the polishing apparatus 300, a processing solution remaining on the substrate surface after polishing is replaced with pure water in the pure water replacement section 192, and the substrate is then returned to the sixth transferring position TP6. For the substrate which has undergone polishing in the polishing apparatus 30D, a processing solution remaining on the substrate surface after polishing is replaced with pure water in the pure water replacement section 194, and the substrate is then returned to the seventh transferring position TP7. The substrate after pure water replacement is moved to the fifth transferring position TP5 by the second linear transporter 6.

The second transfer robot 40 takes the substrate out of the fifth transferring position TP5 and transfers the substrate to the reversing machine 41. The reversing machine 41 reverses the substrate 180° and then transfers it to the first cleaning unit 42, where the substrate is cleaned. The third transfer robot 46 transfers the substrate from the first cleaning unit 42 to the second cleaning unit 43, where the substrate is cleaned.

The third transfer robot 46 transfers the substrate after cleaning to the third cleaning unit 44, where the substrate is cleaned with pure water. The third transfer robot 46 transfers the substrate after pure water cleaning to the drying unit 45, where the substrate is rinsed with pure water and then rotated at a high speed to spin-dry the substrate. The first transfer robot 22 receives the substrate after spin-drying from the drying unit 45 and returns the substrate to the substrate cassette mounted in the front loading section 200.

Example 1

Figure 17:
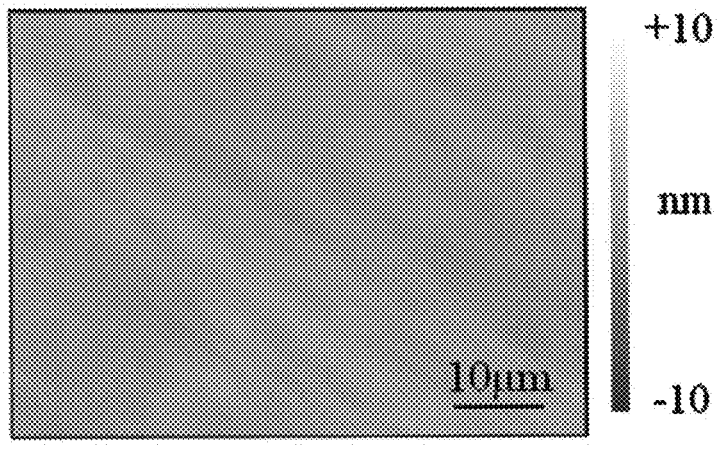
FIG. 17 is a diagram showing an optical microscopic image of a surface of a GaN substrate after processing in Example 1.
Figure 18:
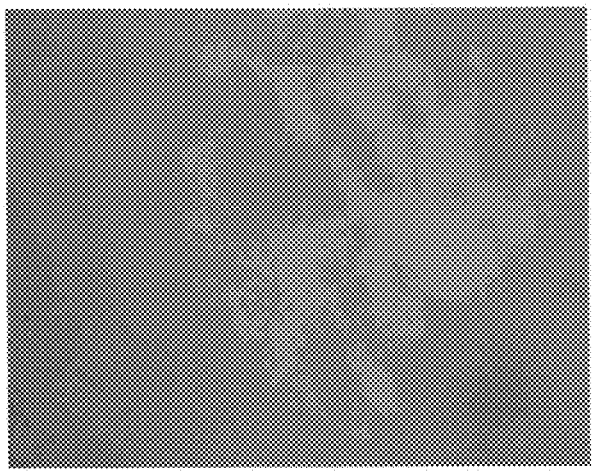
FIG. 18 is a diagram showing an optical microscopic image of the surface of the GaN substrate after processing in Example 1.

Using the polishing apparatus shown in FIG. 8 and using, as a processing solution, a phosphate buffer solution having a pH of 6.86 and containing 10 ppm of Ga ions, polishing of a surface of a Ga substrate was carried out with a polishing tool, composed of quartz glass which is an acidic solid catalyst, for 3 hours while irradiating the surface with ultraviolet light, having a peak emission wavelength of 365 nm, emitted from a light source. FIGS. 17 and 18 show optical microscopic images of the surface of the GaN substrate after processing.

Comparative Examples 1-4

Figure 19:
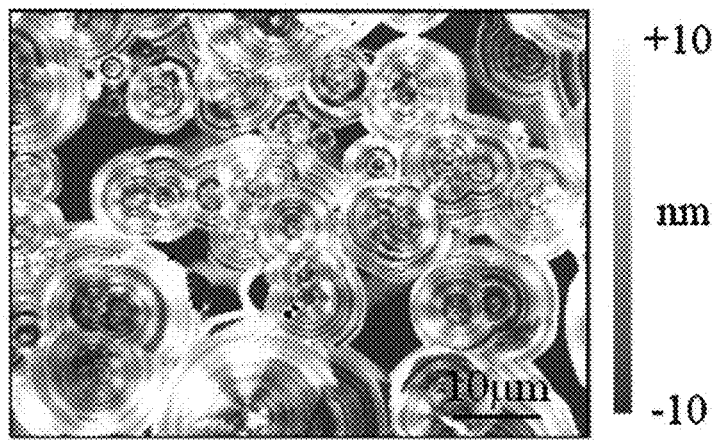
FIG. 19 is a diagram showing an optical microscopic image of a surface of a GaN substrate after processing in Comp. Example 1.
Figure 20:
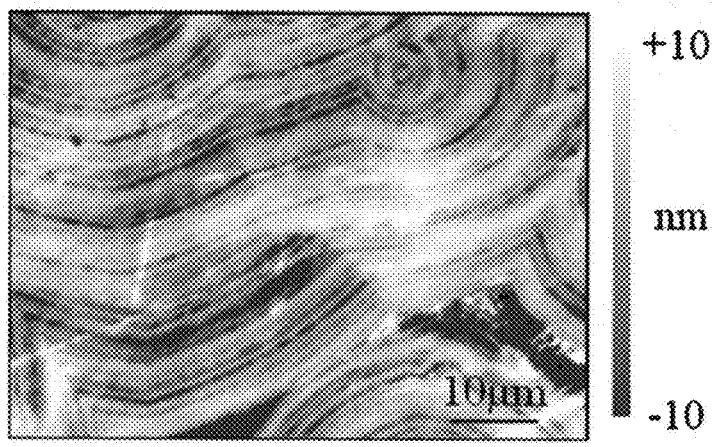
FIG. 20 is a diagram showing an optical microscopic image of a surface of a GaN substrate after processing in Comp. Example 2.

Polishing of a surface of a GaN substrate was carried out in the same manner as in Example 1, except for using a processing solution which was the same as the processing solution used in Example 1, but whose pH was changed to 1 with hydrochloric acid (Comp. Example 1); and a processing solution which was the same as the processing solution used in Example 1, but whose pH was changed to 13 with potassium hydroxide (Comp. Example 2). FIGS. 19 and 20 show optical microscopic images of the surfaces of the GaN substrates after processing in Comp. Examples 1 and 2.

Figure 21:
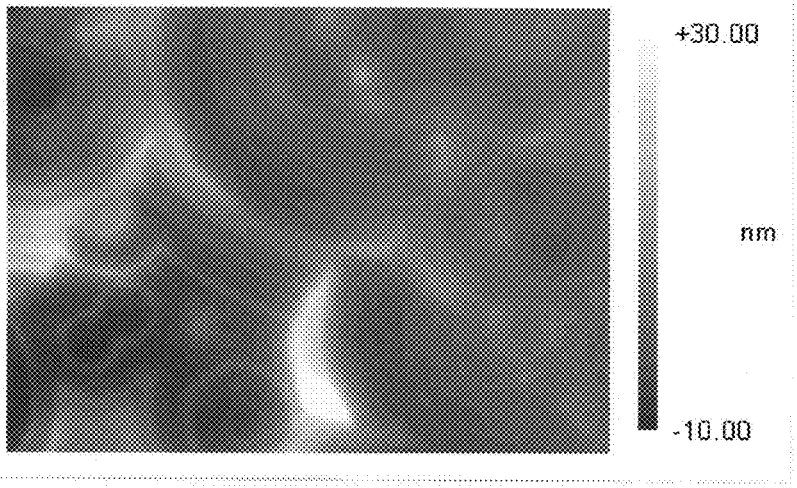
FIG. 21 is a diagram showing an optical microscopic image of a surface of a GaN substrate after processing in Comp. Example 3.
Figure 22:
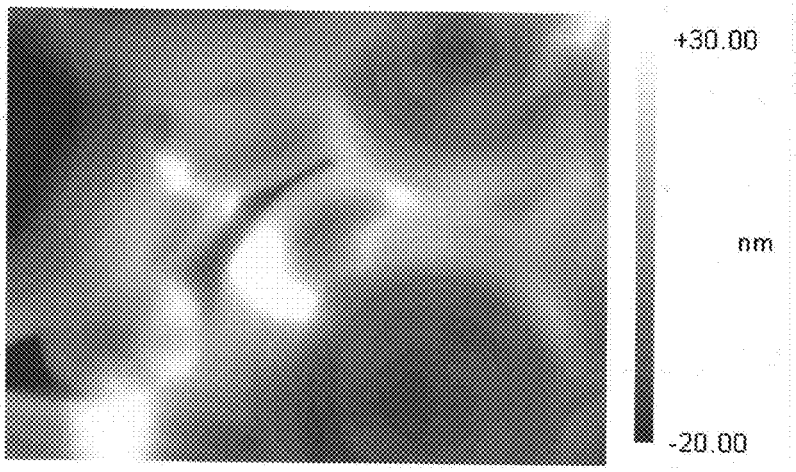
FIG. 22 is a diagram showing an optical microscopic image of a surface of a GaN substrate after processing in Comp. Example 4.

Polishing of a surface of a GaN substrate was carried out in the same manner as in Example 1, except for using a processing solution which was the same as the processing solution used in Example 1, but whose pH was changed to 5 with phosphoric acid ($HPO_3$) (Comp. Example 3); and a processing solution which was the same as the processing solution used in Example 1, but whose pH was changed to 9 with potassium hydroxide (Comp. Example 4). FIGS. 21 and 22 show optical microscopic images of the surfaces of the GaN substrates after processing in Comp. Examples 3 and 4.

As can be seen from FIG. 17 and FIGS. 19 through 22, the use of a neutral processing solution having a pH of 6 to 8, in particular 6.86, can provide a processed surface having lower roughness as compared to the use of an acidic or basic processing solution.

Comparative Example 5

Figure 23:
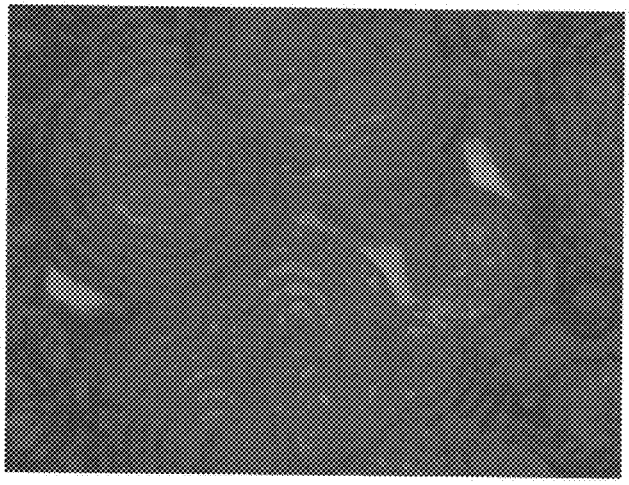
FIG. 23 is a diagram showing an optical microscopic image of a surface of a GaN substrate after processing in Comp. Example 5.

In order to confirm the effect of the inclusion of Ga ions in a processing solution, polishing of a surface of a GaN substrate was carried out in the same manner as in Example 1, except for using a processing solution which was the same as the processing solution used in Example 1, but contained no Ga ions (Comp. Example 5). FIG. 23 shows an optical microscopic image of the surface of the GaN substrate after processing.

As can be seen from FIGS. 18 and 23, the surface roughness (RMS: 0.404 nm) of the processed substrate of Example 1 is significantly lower than the surface roughness (RMS: 11.662 nm) of the processed substrate of Comp. Example 5. This indicates that the inclusion of Ga ions in a neutral buffer solution can significantly improve the surface roughness of a processed surface.

Comparative Example 6

Figure 24:
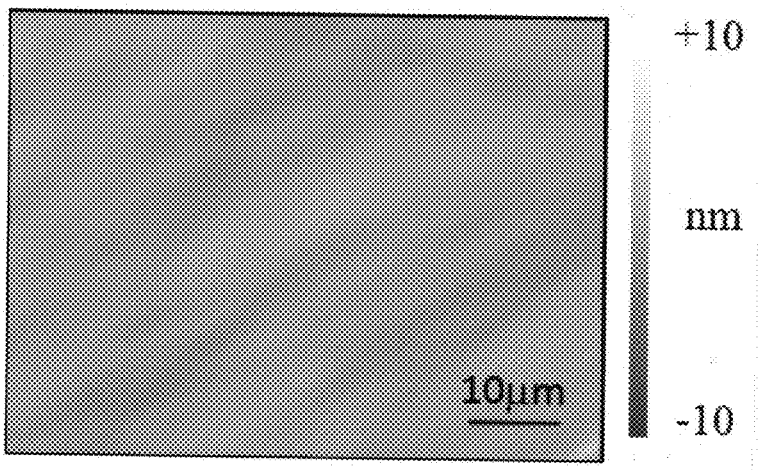
FIG. 24 is a diagram showing an optical microscopic image of a surface of a GaN substrate after processing in Comp. Example 6.

In order to confirm a reducing effect in time required to polish by the inclusion of Ga ions in a processing solution, polishing of a surface of a GaN substrate was carried out in the same manner as in Comp. Example 5, except for changing the processing time to 40 hours (Comp. Example 6). FIG. 24 shows an optical microscopic image of the surface of the GaN substrate after processing. As can be seen from FIGS. 18 and 24, the surface roughness (RMS: 0.636 nm) of the processed substrate of Comp. Example 6, in which the processing was carried out for 40 hours using the processing solution containing no Ga ions, is almost equal to that of Example 1 in which the processing was carried out for 3 hours using the processing solution containing Ga ions. This indicates that the inclusion of Ga ions in a neutral buffer solution can significantly shorten the time it takes to polish and flatten a surface of a GaN substrate.

Figure 25:
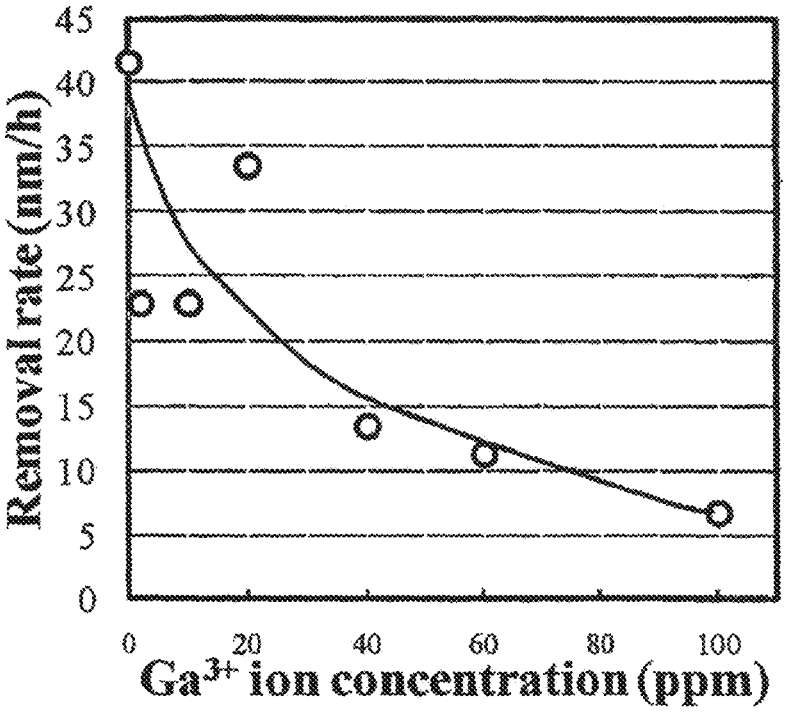
FIG. 25 is a graph showing the relationship between Ga ion ($Ga^{3+}$ ion) concentration and polishing rate (removal rate).

A further experiment was conducted in which polishing of a surface of a GaN substrate was carried out in the same manner as in Example 1, using phosphate buffer solutions having a pH of 6.86 and containing Ga ions at varying concentrations. For the GaN substrate samples tested, the polishing rates (removal rates) were measured. FIG. 25 shows the relationship between the Ga ion ($Ga^{3+}$ ion) concentration and the polishing rate (removal rate). As can be seen from FIG. 25, the processing (polishing) rate decreases with increase in the Ga ion concentration. It was also found that at a Ga ion concentration of less than 5 ppm, the processed surface has a high surface roughness RMS of not less than 5 nm, whereas the surface roughness RMS of the processed surface is as low as not more than 1 nm at a Ga ion concentration of not less than 10 ppm. This is considered to be due to the fact that the inclusion of an effective amount of Ga ions in the solution inhibits isotropic etching of the surface oxide in recessed portions of the substrate surface, whereby only raised portions of the substrate surface are removed catalytically.

Thus, the Ga ion concentration of a processing solution is preferably not less than 10 ppm. If the Ga ion concentration is less than 10 ppm, the surface roughness of a processed substrate will be high or poor as shown in FIG. 23. On the other hand, the Ga ion concentration of a processing solution is preferably not more than 100 ppm, because a processing solution can turn into a gel when the Ga ion concentration is more than 100 ppm.

While the present invention has been described with reference to preferred embodiments, it is understood that the present invention is not limited to the embodiments, but is capable of various modifications within the general inventive concept described herein.

INDUSTRIAL APPLICABILITY

The present invention is applicable to a polishing method and a polishing apparatus for processing and flattening a surface (surface to be processed) of a substrate, such as an elemental substrate of a compound semiconductor containing Ga (gallium) element or a bonded substrate (epitaxial substrate) having a layer of Ga element-containing compound semiconductor.

The invention claimed is:

1. A polishing method comprising:

preparing a Ga element-containing compound semiconductor substrate, whose surface has raised portions and recessed portions;

immersing the substrate in a processing solution comprising a buffer solution containing Ga ions, a concentration of the Ga ions being in a range of 10 ppm to 100 ppm, and the buffer solution having a pH in a range of 6 to 8;

irradiating the surface of the substrate with light or applying a bias potential to the substrate, or applying a bias potential to the substrate while irradiating the surface of the substrate with light, thereby forming Ga oxide on the surface of the substrate in the processing solution; and rotating the substrate and a polishing tool with respect to each other to selectively polish and remove the Ga oxide formed on the raised portions of the surface of the substrate, wherein the processing solution contains oxygen dissolved therein, and wherein the processing solution does not comprise nitrogen dissolved from any Ga element-containing compound semiconductor substrate.

2. The polishing method according to claim 1, wherein the polishing tool has an acidic or basic solid catalyst at least in a surface area which comes into contact with or close to the substrate.

3. The polishing method according to claim 1, wherein the processing solution further comprises metal oxide particles, diamond particles, or catalyst particles whose surfaces are modified with an acidic or basic functional group, or a mixture of these particles.

4. The polishing method according to claim 1, wherein the processing solution further comprises an oxidizing agent.

5. The polishing method according to claim 1, wherein at least a surface area of the polishing tool, which comes into contact with or close to the substrate, has been conditioned to have desired flatness and appropriate roughness.

6. The polishing method according to claim 1, further comprising:

preparing the processing solution prior to immersing the substrate in the processing solution.

* * * * *